US007895859B2

(12) United States Patent
Anselmino et al.

(10) Patent No.: US 7,895,859 B2
(45) Date of Patent: Mar. 1, 2011

(54) ICE MAKING AND DISPENSING SYSTEM

(75) Inventors: Jeffery J. Anselmino, St. Joseph, MI (US); Jim J. Pastryk, Sawyer, MI (US); Nihat Cur, St. Joseph, MI (US); Andrew M. Tenbarge, St. Joseph, MI (US); Karen J. Querfurth, Coloma, MI (US); Douglas D. Leclear, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/388,096

(22) Filed: Feb. 18, 2009

(65) Prior Publication Data

US 2009/0145158 A1 Jun. 11, 2009

Related U.S. Application Data

(62) Division of application No. 11/830,162, filed on Jul. 30, 2007, now Pat. No. 7,509,818, which is a division of application No. 10/973,516, filed on Oct. 26, 2004, now Pat. No. 7,266,951.

(51) Int. Cl.
*F25C 5/18* (2006.01)

(52) U.S. Cl. ..... 62/344

(58) Field of Classification Search ..... 62/344
See application file for complete search history.

(56) References Cited

U.S. PATENT DOCUMENTS

| | | | | |
|---|---|---|---|---|
| 2,692,809 | A * | 10/1954 | Kesling | 312/405 |
| 2,712,733 | A | 7/1955 | King | |
| 3,146,601 | A | 9/1964 | Gould | |
| 3,146,606 | A | 9/1964 | Grimes | |
| 3,226,939 | A | 1/1966 | Harbison | |
| 3,270,519 | A | 9/1966 | Pohl, Jr. | |
| 3,429,140 | A | 2/1969 | White | |
| 3,561,231 | A | 2/1971 | Webb | |
| 3,602,007 | A | 8/1971 | Drieci | |
| 3,640,088 | A | 2/1972 | Jacobus | |
| 3,747,363 | A | 7/1973 | Grimm | |
| 3,798,923 | A * | 3/1974 | Pink et al. | 62/266 |
| 3,969,909 | A | 7/1976 | Barto et al. | |
| 4,084,725 | A | 4/1978 | Buchser | |
| 4,087,140 | A | 5/1978 | Linstromberg | |
| 4,100,761 | A | 7/1978 | Linstromberg | |
| 4,209,999 | A | 7/1980 | Falk et al. | |
| 4,227,383 | A | 10/1980 | Horvay | |
| 4,285,212 | A | 8/1981 | Prada | |
| 4,306,757 | A | 12/1981 | Horvay | |
| 4,333,588 | A | 6/1982 | Schreck | |
| 4,543,800 | A | 10/1985 | Mawby | |
| 4,732,301 | A * | 3/1988 | Tobias et al. | 222/203 |
| 5,077,985 | A | 1/1992 | Buchser | |
| 5,117,654 | A | 6/1992 | Steffenhagen | |
| 5,165,255 | A | 11/1992 | Alvarez et al. | |
| 5,211,462 | A | 5/1993 | Bien | |
| 5,272,888 | A | 12/1993 | Fisher | |

(Continued)

FOREIGN PATENT DOCUMENTS

EP 1445558 A2 11/2004

(Continued)

*Primary Examiner* — William E Tapolcai

(57) ABSTRACT

An dispensing system suitable for lifting and dispensing ice through the refrigerator compartment door of a bottom-mount refrigerator or lifting and dispensing ice from an undercounter ice maker to a dispenser on the countertop.

7 Claims, 28 Drawing Sheets

U.S. PATENT DOCUMENTS

| | | | | |
|---|---|---|---|---|
| 5,273,219 | A | 12/1993 | Beach, Jr. | |
| 5,359,795 | A | 11/1994 | Mawby et al. | |
| 5,729,997 | A | 3/1998 | Witsoe | |
| 5,737,932 | A | 4/1998 | Lee | |
| 5,787,724 | A | 8/1998 | Pohl et al. | |
| 5,813,245 | A | 9/1998 | Coates et al. | |
| 5,899,083 | A | 5/1999 | Peterson | |
| 5,947,342 | A | 9/1999 | Song | |
| 5,956,967 | A | 9/1999 | Kim | |
| 6,019,447 | A | 2/2000 | Jackovin | |
| 6,050,097 | A | 4/2000 | Nelson | |
| 6,082,130 | A | 7/2000 | Pastryk | |
| 6,120,685 | A | 9/2000 | Carlson et al. | |
| 6,135,173 | A | 10/2000 | Lee et al. | |
| 6,148,624 | A | 11/2000 | Bishop | |
| 6,167,711 | B1 * | 1/2001 | Slattery et al. | 62/78 |
| 6,276,146 | B1 | 8/2001 | Kim et al. | |
| 6,286,324 | B1 | 9/2001 | Pastryk | |
| 6,314,745 | B1 | 11/2001 | Janke | |
| 6,351,958 | B1 | 3/2002 | Pastryk | |
| 6,438,976 | B2 | 8/2002 | Shapiro | |
| 6,442,954 | B1 | 9/2002 | Shapiro | |
| 6,460,367 | B1 | 10/2002 | DuHack | |
| 6,474,094 | B2 | 11/2002 | Kim | |
| 6,532,758 | B2 | 3/2003 | DuHack | |
| 6,571,567 | B2 | 6/2003 | An et al. | |
| 6,735,959 | B1 | 5/2004 | Najewicz | |
| 6,742,353 | B2 | 6/2004 | Ohashi et al. | |
| 6,810,682 | B1 | 11/2004 | Schuchart et al. | |
| 6,880,355 | B2 | 4/2005 | Jung | |
| 6,964,177 | B2 | 11/2005 | Lee | |
| 7,065,975 | B1 * | 6/2006 | Herndon et al. | 62/66 |
| 7,392,665 | B2 | 7/2008 | Lee et al. | |
| 7,428,820 | B2 | 9/2008 | Kim et al. | |
| 7,484,382 | B2 | 2/2009 | Kim et al. | |
| 7,490,475 | B2 | 2/2009 | Kim et al. | |
| 7,509,818 | B2 * | 3/2009 | Anselmino et al. | 62/344 |
| 2001/0025505 | A1 | 10/2001 | Nelson | |
| 2002/0083731 | A1 | 7/2002 | Kim | |
| 2006/0218961 | A1 | 10/2006 | Kim | |

FOREIGN PATENT DOCUMENTS

| | | | |
|---|---|---|---|
| JP | 47-026464 | | 11/1972 |
| JP | 50069644 | A | 6/1975 |
| JP | S50-154565 | A | 12/1975 |
| JP | S53-41815 | A | 11/1978 |
| JP | S56-94462 | U | 7/1981 |
| JP | 06-011228 | A | 1/1994 |
| JP | 06-33326 | B | 8/1994 |
| JP | 07-190578 | A | 7/1995 |
| JP | 10-148437 | A | 6/1998 |
| JP | 10-188125 | A | 7/1998 |
| JP | 10-197119 | A | 7/1998 |
| JP | H10-206004 | A | 8/1998 |
| JP | 1999325691 | A | 11/1999 |
| JP | 2000009372 | A | 1/2000 |
| JP | 2000105052 | A | 4/2000 |
| JP | 2000111229 | A | 4/2000 |
| JP | 2000146421 | A | 5/2000 |
| JP | 2000320943 | A | 11/2000 |
| JP | 2001221555 | A | 8/2001 |
| JP | 2002162139 | A | 6/2002 |
| JP | 2002350021 | A | 12/2002 |
| JP | 2002372349 | A | 12/2002 |
| JP | 2003056966 | A | 2/2003 |
| JP | 2003075050 | A | 3/2003 |
| JP | 2003090667 | A | 3/2003 |
| JP | 2003121043 | A | 4/2003 |
| KR | 19970001294 | B1 | 2/1997 |
| KR | 1998018912 | U | 7/1998 |
| KR | 1999021017 | A | 3/1999 |
| KR | 1999030143 | A | 4/1999 |
| KR | 19970001293 | A | 5/1999 |
| KR | 19990031465 | A | 5/1999 |
| KR | 19970062375 | B1 | 6/1999 |
| KR | 19990021540 | U | 6/1999 |
| KR | 19990043740 | A | 6/1999 |
| KR | 19990062189 | A | 7/1999 |
| KR | 19990065602 | A | 8/1999 |
| KR | 19990066209 | A | 8/1999 |
| KR | 20000028513 | A | 5/2000 |
| KR | 20000050416 | A | 8/2000 |
| KR | 20010008710 | A | 2/2001 |
| KR | 20010029590 | A | 4/2001 |
| WO | 03033976 | A1 | 4/2003 |
| WO | 03102481 | A1 | 12/2003 |

* cited by examiner

ICE MAKING AND DISPENSING SYSTEM

CROSS-REFERENCE TO RELATED APPLICATIONS

The present application constitutes a divisional application of U.S. patent application Ser. No. 11/830,162, entitled "ICE MAKING AND DISPENSING SYSTEM" now U.S. Pat. No. 7,509,818, which is a division of U.S. patent application Ser. No. 10/973,516, entitled "ICE MAKING AND DISPENSING SYSTEM" now U.S. Pat. No. 7,266,951 filed Oct. 26, 2004.

BACKGROUND OF THE INVENTION

1. Field of the Invention

The invention relates to an ice making and dispensing system. In one aspect, the invention relates to a bottom-mount refrigerator comprising a freezer-mounted ice maker and an ice cube lifter for delivering ice cubes to a dispenser mounted in the refrigerator compartment door. In another aspect, the invention relates to an under-the-counter ice maker having an ice cube lifter for delivering ice cubes to above-the-counter dispenser outlet.

2. Description of the Related Art

In today's household refrigerator market, there are three basic configurations to choose from: a bottom-mount refrigerator in which the refrigerated compartment is located above the freezer compartment, a top-mount refrigerator in which the freezer compartment is located above the refrigerated compartment, and a side-by-side refrigerator in which the refrigerated compartment and freezer compartment extend the entire height of the refrigerator.

Of these three configurations, the bottom-mount configuration is considered by many consumers to have the most convenient configuration since most consumers access the refrigerated compartment of a refrigerator far more frequently than the freezer compartment. The upper position of the refrigerated compartment in a bottom-mount configuration positions the majority of the contents of the refrigerated compartment at the standing height of the consumer, negating the need for the consumer to stoop or bend over to see or select items. Therefore, a combination refrigerator with the freezer on the bottom provides the user with the greatest convenience by providing the maximum fresh food compartment space at eye-level and within easy reach.

One of the most desired accessories for a household refrigerator is a through-the-door ice and water dispenser. A through-the-door ice and water dispenser is desirable because it greatly simplifies the process of retrieving ice cubes, i.e. it eliminates opening the door, removing the ice storage container, separating and scooping ice cubes, and pouring the ice cubes into a glass. The feature also is viewed as an energy saver, since the freezer door is not opened as often.

However, of these three configurations, typically only the side-by-side configuration offers a through-the-door ice and water system. The side-by-side configuration is best suited for through-the-door ice dispensing because the freezer door extends the height of the refrigerator cabinet, which permits the ice dispenser to be located in the freezer door at a height convenient for the user. In contrast, the top-mount and bottom-mount refrigerators have freezer door locations that would place the ice dispenser either too high or too low for convenient use by the consumer. In particular, locating the ice dispenser in a bottom-mount refrigerator involves two problems that must be overcome. First, if ice is made and/or stored in the refrigerated compartment, it will melt if not insulated from and chilled independently of the refrigerated compartment. Second, if ice is made and/or stored in the freezer compartment, it must be transported upwardly for dispensing through the ice and water dispenser.

With current ice making and dispensing technology, it has not been possible for a consumer to have the most convenient refrigerator configuration with the most desired accessory. In other words, bottom-mount refrigerators have not been available with through-the-door ice and water dispensing. Thus, it would be desirable to have an ice making and dispensing system that can be used to dispense the ice through the refrigerated compartment door of a bottom-mount refrigerator to provide the consumer with both the bottom-mount configuration and the through-the-door ice and water dispensing functionality.

Undercounter ice makers are a desirable addition to kitchens and entertainment centers in homes. However, undercounter ice makers for home use have not been available with dispensers for dispensing ice at the countertop level.

SUMMARY OF THE INVENTION

The invention relates to an appliance for making and dispensing ice cubes having an ice maker compartment including an ice maker for generating ice cubes, a dispenser outlet located above the ice maker compartment and an ice dispenser operably connecting the ice maker to the dispenser outlet. The ice dispenser includes a lifter positioned outside the ice maker compartment for moving ice cubes toward the dispenser outlet.

The appliance can include an ice cube storage bin.

The lifter includes an outlet through which ice cubes are expelled from the lifter. The lifter outlet can be directly connected to the dispenser outlet to directly dispense ice cubes to the dispenser outlet. The lifter outlet can be connected to a dispenser mechanism arranged to dispense ice cubes and crushed ice.

The ice cube storage bin can be located adjacent the dispenser outlet. The lifter outlet can be connected to the ice cube storage bin such that the lifter moves the ice cubes to the ice cube storage bin for storage prior to dispensing through the dispenser outlet.

In another aspect the ice cube storage bin can be positioned to receive ice cubes from the ice maker and the lifter extends from the ice cube storage bin to the dispenser outlet. The lifter can be positioned outside the ice cube storage bin.

The lifter can comprise an elevator having a lifting platform that is movable between a loading position where ice cubes can be loaded onto the platform and a dispensing position where the ice cubes are positioned for dispensing through the dispenser outlet. The dispenser can include a deflector to deflect ice cubes carried by the platform to the dispenser outlet.

The deflector can be a stripper having multiple teeth and the lifting platform can have multiple openings corresponding to the teeth. The teeth are received within the openings as the platform is lifted to strip ice cubes off the platform.

In another aspect the lifter can comprise an auger. The auger can be helical.

In another aspect the lifter can comprise a conveyor. The conveyor can comprise an endless belt with at least one projection extending from the belt for supporting at least one ice cube.

In another aspect the lifter can comprise an accelerator that propels ice cubes toward the dispenser outlet. The lifter can include a conduit extending toward the dispenser outlet and the accelerator propels the ice cubes with sufficient velocity to carry ice cubes to the dispenser outlet. The conduit can include a return conduit for ice cubes falling back down the conduit. The accelerator can comprise a rotatable impeller having at least one blade to contact and propel ice cubes.

In another aspect of the invention the appliance can be an undercounter freezer and the dispenser outlet is positioned on a countertop above the freezer. The dispenser includes a lifter extending from adjacent the freezer compartment to the dispenser outlet.

In another aspect of the invention the appliance can be a bottom freezer refrigerator having a refrigerator compartment maintained at a temperature above 0° C. The dispenser outlet is positioned on the refrigerator compartment door and the ice maker is positioned in the freezer compartment. An ice cube storage bin can be located in the freezer compartment and the lifter can carry ice cubes from the ice cube storage bin to the dispenser outlet. Alternately, the ice cube storage bin can be located on the refrigerator compartment door and the lifter can carry ice cubes from the ice maker to the ice cube storage bin.

The lifter can extend along the wall of the refrigerator compartment and the freezer compartment. A connector can lead from the lifter outlet to the dispenser outlet.

In another aspect of the invention the appliance can be an undercounter ice maker and the dispenser outlet can be positioned on the countertop above the undercounter ice maker. The undercounter ice maker can include an ice cube storage bin and the lifter can be positioned adjacent the undercounter ice maker and can be connected to the ice cube storage bin.

The lifter can be an elevator having a lifting platform that is movable between a loading position where ice cubes are loaded from the ice cube storage bin and a dispensing position where ice cubes are positioned for dispensing from the dispenser outlet. The lifter can include a deflector comprising a stripper to remove ice cubes from the platform at the dispensing position.

In another aspect the lifter can be an accelerator having a conduit extending toward the dispenser outlet. The accelerator propels ice cubes into the conduit with sufficient velocity to carry the ice cubes to the dispenser outlet.

The undercounter ice maker can include a mover in the ice cube storage bin to move ice cubes to the accelerator inlet. The undercounter ice maker can include a drain and the conduit can include a return duct with an inlet in the conduit. The conduit can include a baffle movable between a first position where in blocks ice cubes from entering the return duct while leaving the conduit open and a second position where it closes the conduit while leaving the return duct open to permit falling ice cubes to enter the return duct. The return duct can lead to the drain. The undercounter ice maker can include a drain pan connected to the drain and the return duct can lead to the drain pan.

The lifter can be an elevator, a conveyor, an auger or an accelerator. The lifter can comprise a first lifter positioned in the ice cube storage bin arranged to move ice cubes to a second lifter positioned outside the ice cube storage bin. The second lifter can be arranged to carry ice cubes to the dispenser outlet.

In another aspect the invention relates to a refrigerator having a cabinet defining a freezer compartment maintained at a temperature below 0° C. and a refrigerator compartment located substantially above the freezer compartment and maintained at a temperature above 0° C. The refrigerator includes a refrigerator compartment door moveably mounted to the cabinet for selectively closing the refrigerator compartment. The refrigerator includes an ice maker for generating ice cubes located in the freezer compartment and a dispenser outlet on the refrigerator compartment door. The refrigerator includes an ice dispenser operably connecting the ice maker to the dispenser outlet such that ice cubes generated by the ice maker are dispensed through the dispenser outlet.

The dispenser comprises a lifter extending toward the dispenser outlet to move ice cubes from the freezer compartment to a position suitable for dispensing through the dispenser outlet. The refrigerator can include an ice cube storage bin from receiving ice cubes generated by the ice maker. The lifter can extend from adjacent the ice cube storage bin toward the dispenser outlet.

The lifter can be an elevator, a conveyor, an auger or an accelerator.

In another aspect the invention relates to a method of dispensing ice cubes through the refrigerator compartment door of a bottom freezer refrigerator having an automatic ice maker in the freezer compartment and a dispenser outlet on the refrigerator compartment door and a lifter to lift ice cubes from the ice maker to the dispenser outlet. The method includes operating the refrigerator system to cool the refrigerator and freezer compartments, filling the ice maker with water and forming ice cubes, harvesting ice cubes and operating the lifter for dispensing ice cubes through the dispenser outlet.

The refrigerator can include an ice cube storage bin and the method can include storing ice cubes harvested from the ice maker in the ice cube storage bin. The lifter can be connected to the ice cube storage bin and the step of operating the lifter includes moving ice cubes from the ice cube storage bin to the lifter. The ice cube storage bin can include a mover and the step of moving ice cubes from the storage bin to the lifter includes operating the mover.

In another aspect the invention relates to a method of dispensing ice cubes from an undercounter ice maker having an ice cube storage bin and a dispensing head positioned on a counter surface. The undercounter ice maker includes a lifter having a first lifter portion in the ice cube storage bin and a second lifter portion positioned adjacent the undercounter ice maker extending to the dispensing head. The method includes operating the ice making apparatus to form ice cubes, harvesting ice cubes into the ice cube storage bin and dispensing ice cubes. The step of dispensing ice cubes includes operating the first lifter portion to move ice cubes from the ice cube storage bin to the second lifter portion and operating the second lifter portion to move ice cubes to the dispenser head.

DESCRIPTION OF THE INVENTION

The inventive concept described herein relates to an ice dispensing unit for dispensing ice at a height convenient for a user, i.e. the user can retrieve ice while in a standing position, which is located above the ice maker apparatus. Several embodiments are described with an ice making and storage unit located in a compartment for forming ice cubes and a lifting apparatus for transporting the ice upwardly to a dispensing unit mounted in a space located above the ice cube forming compartment having an above-freezing temperature.

It should be noted that the embodiments described hereinafter share many of the same elements, such as a refrigerated compartment, freezer compartment, refrigerator and freezer compartment doors, a dispenser outlet mounted in the refrigerator compartment door, an ice maker, an ice cube storage container, and the like. It will be understood that the operation of these elements will generally be the same for each embodiment, and a description of their operation will not be repeated for each embodiment, unless otherwise noted. As well, elements common to more than one embodiment will be identified with common numerals. Ice cubes are illustrated in the Figures as generally semicircular pieces of ice, although the inventive concepts described herein are not so limited, and are equally applicable to ice particles having a cylindrical, rectilinear, or other shape. The term refrigerator is generally used to refer to an appliance with having both a refrigerated compartment and freezer compartment. However, it can apply to an appliance with only a refrigerated compartment or with only a freezer compartment.

The ice lifting apparatus embodiments according to the invention can be used with an undercounter ice maker or undercounter freezer to supply ice cubes to an ice dispenser outlet positioned on the counter top adjacent the ice maker. As above, operation of elements of the ice lifter apparatus used with an undercounter ice maker will be generally the same as when used in conjunction with a bottom-freezer refrigerator, and a description of their operation will not be repeated, unless otherwise noted.

Figure 1:
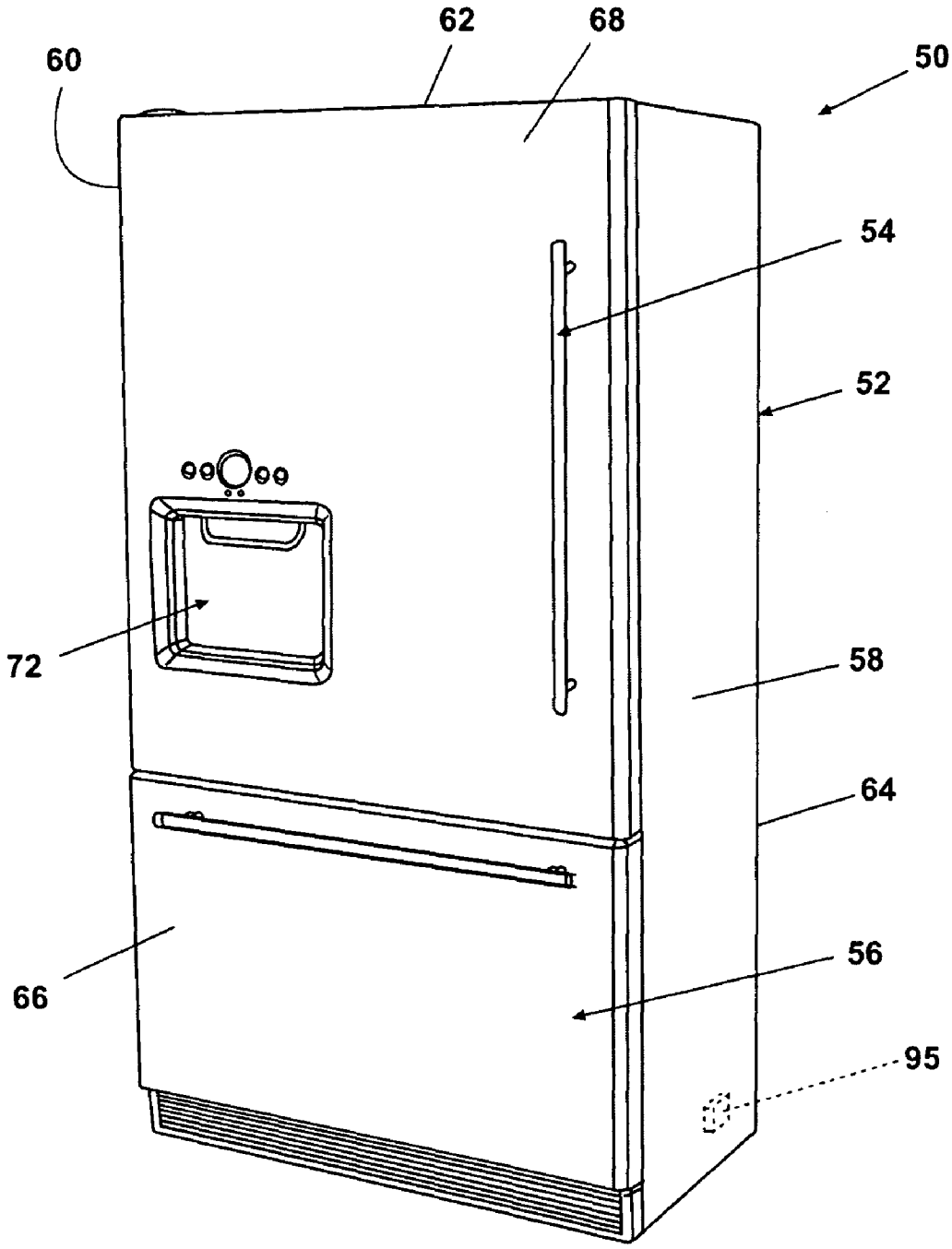
FIG. 1 is a perspective view of a bottom-mount freezer refrigerator comprising alternate embodiments of an ice forming and dispensing unit providing through-the-door ice cube and water dispensing.
Figure 2:
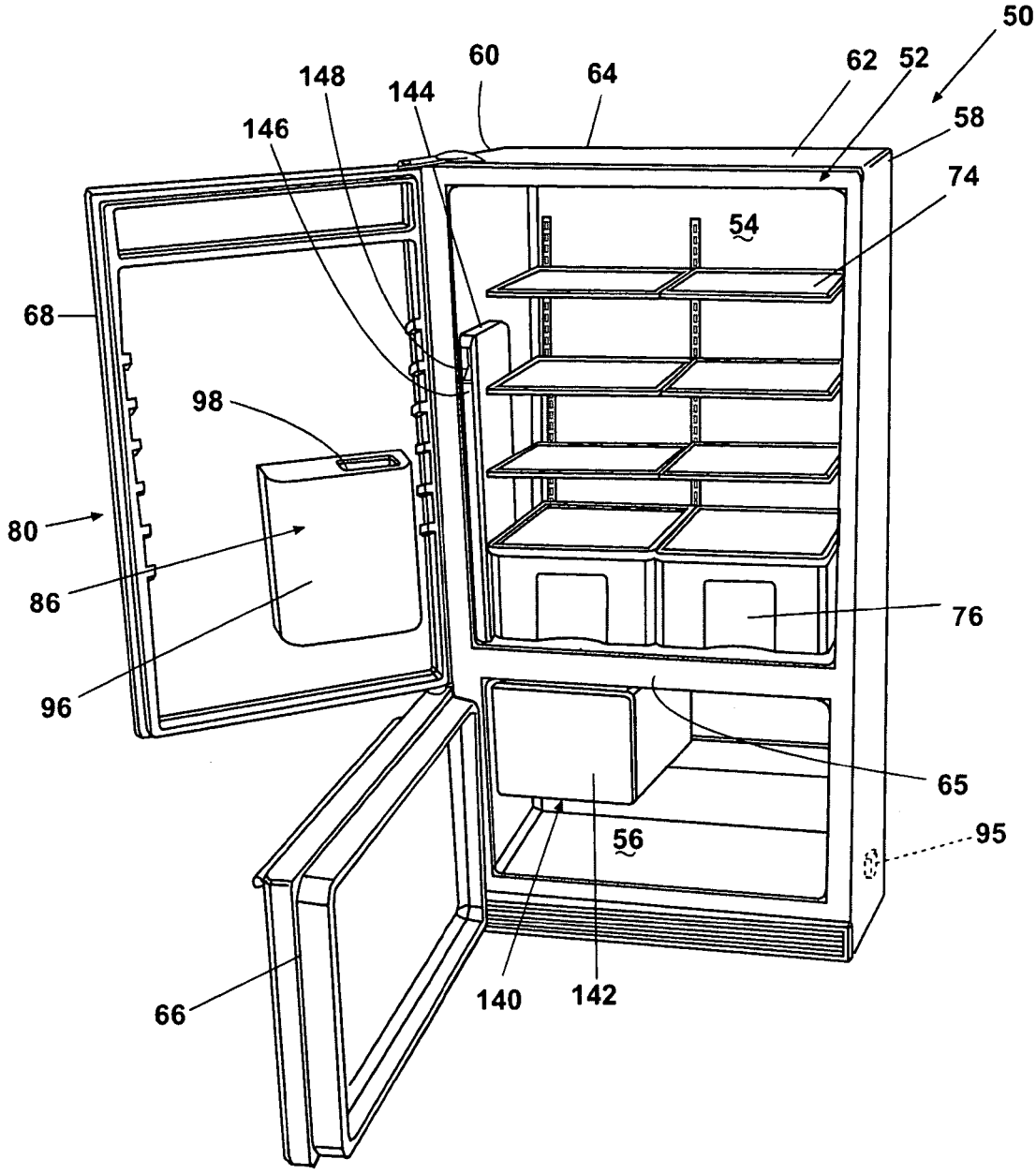
FIG. 2 is a perspective view similar to FIG. 1 with the refrigerator and freezer compartment doors open illustrating a freezer-mounted ice cube forming and dispensing apparatus and ice lifter according to the invention.

FIGS. 1 and 2 illustrate a bottom-mount refrigerator 50 comprising an embodiment of an ice-making and dispensing apparatus according to the invention. The refrigerator 50 comprises a generally well-known insulated cabinet 52 defining an upper refrigerator compartment 54 arranged to operate at above 0° C. temperatures and a lower freezer compartment 56 arranged to operate at below 0° C. temperatures and located beneath the refrigerator compartment 54. The cabinet 52 comprises a pair of insulated sidewalls 58, 60, an insulated top wall 62, and an insulated back wall 64. A compartment separator 65 bisects the interior of the cabinet 52 and separates the refrigerator compartment 54 from the freezer compartment 56.

An insulated freezer compartment door 66 can be hingedly mounted to the cabinet 52 to provide selective access to the freezer compartment 56. Similarly, an insulated refrigerator compartment door 68 can be hingedly mounted to the cabinet 52 to provide selective access to the refrigerator compartment 54. While the freezer compartment door 66 is illustrated as being hingedly mounted about a vertical axis, it could also be configured as a horizontally translating pullout freezer drawer.

The refrigerator 50 also comprises shelves 74 and storage bins 76, which are illustrated in FIG. 2 in the refrigerated compartment 54, but which can also be located in the freezer compartment 56. The refrigerator 50 also comprises a traditional cooling system comprising a motor driven compressor and evaporator containing a suitable coolant, one or more ventilation fans, appropriate thermostatic controls for maintaining the refrigerator compartment 54 and the freezer compartment 56 at selected temperatures, and other well-known functional features (not shown), which are not germane to the inventive concepts and will not be further described herein, except as necessary for a complete understanding of the inventive concepts.

Figure 4:
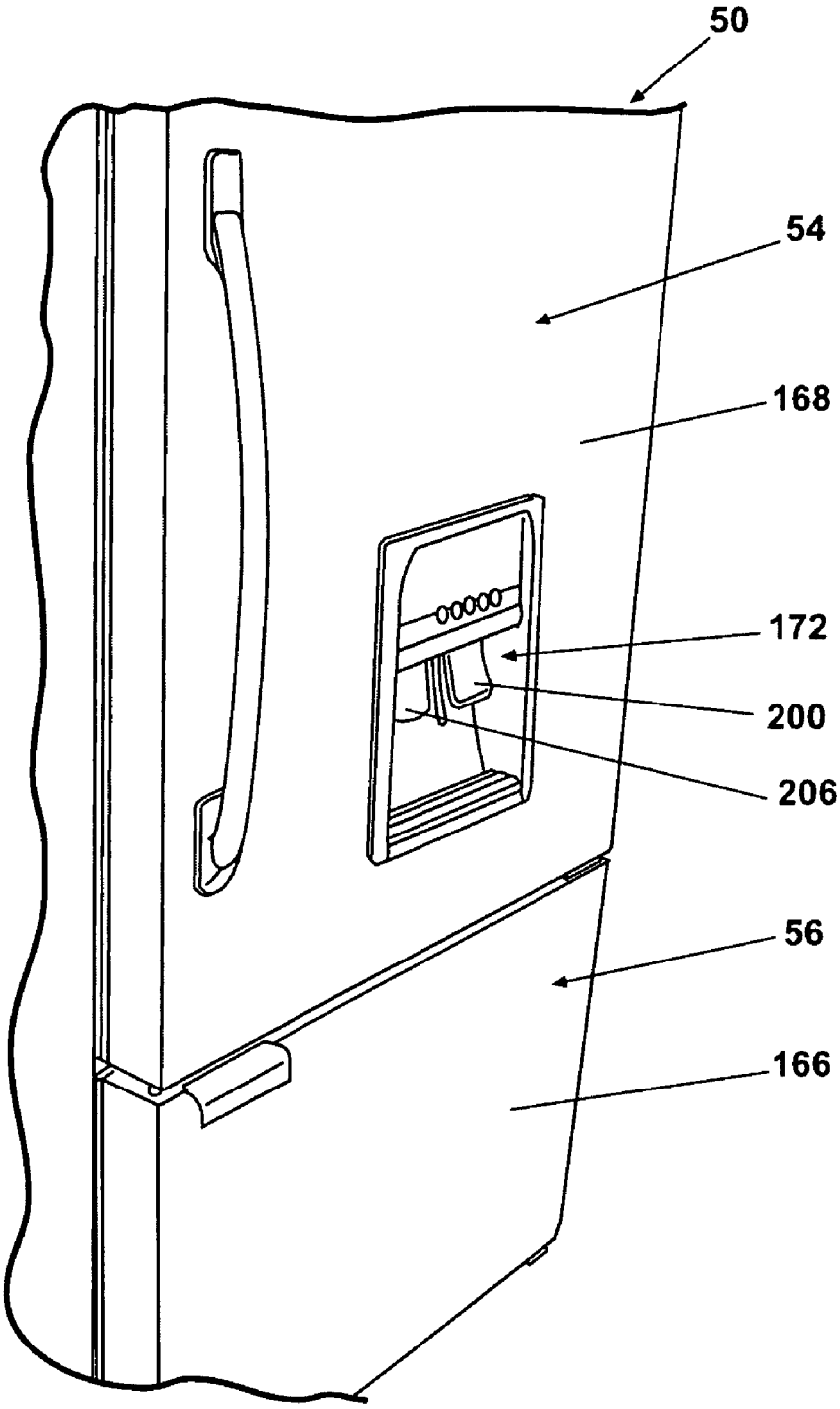
FIG. 4 is a perspective view of another embodiment of a bottom-mount freezer refrigerator comprising an embodiment of the an ice forming and dispensing unit providing through-the-door ice cube and water dispensing.

An ice and water dispenser 72 including an ice dispenser outlet, not shown, can be installed in refrigerator compartment door 68 for delivering ice and water through the refrigerated compartment door 68. The dispenser 72 can be similar in many respects to an ice and water dispenser disclosed in U.S. Pat. No. 6,082,130 to Pastryk et al which is incorporated herein in its entirety. Dispenser 72 can also be similar to water and ice dispensers disclosed in U.S. Pat. No. 4,084,725 to Buchser, U.S. Pat. No. 4,176,527 to Linstromberg et al, and U.S. Pat. No. 4,942,979 to Linstromberg et al which are each incorporated herein in their entirety. While the Pastryk et al patent and Linstromberg et al patents disclose ice crushing mechanisms incorporated in the ice storage bin and ice dispensing apparatus, those skilled in the art will understand that the dispenser 72 can be arranged to deliver whole ice cubes, or can be arranged to selectively deliver whole or crushed ice cubes and/or water in response to activation of a selection control device (not shown) incorporated into the dispenser 72. Typically through-the-door dispensers include one or two actuators (see FIG. 4) for activating ice cube or chilled water dispensing by pressing a glass or suitable container against the actuator. As is well understood by those skilled in the art, pressing the ice dispensing actuator can cause an ice passage door, not shown, to open a dispenser outlet, not shown, and close a switch to activate the ice dispensing apparatus. When the glass or container is removed the ice passage door can close and the ice dispensing apparatus de-energized. Dispenser 72 can also include a user interface, not shown, that can include suitable controls for the ice and water dispenser and, if desired, other refrigerator functions. The ice and water dispenser controls can be similar to the ice and water dispenser controls disclosed in U.S. patent application Ser. No. 10/861,203, now U.S. Pat. No. 7,201,005, which is incorporated herein in its entirety.

FIG. 2 illustrates an embodiment of an ice making and dispensing apparatus 140 comprising an ice maker and storage container module 142 mounted in the freezer compartment 56. Ice making and dispensing apparatus 140 can include a lifting mechanism 144 for lifting ice cubes from the freezer compartment 56 to a dispenser module 86 in operable communication with a dispenser 72 that can be positioned on refrigerator compartment door 68 as described above or on a countertop. If desired, an ice cube storage bin (not shown) can be included in module 86 and can be provided with an ice crushing feature as described in the Pastryk et al patent as described above. Those skilled in the art will understand that the dispenser 72 can be arranged to deliver whole ice cubes, or can be arranged to selectively deliver whole or crushed ice cubes and/or water in response to activation of a selection control device (not shown) incorporated into the dispenser 72. If an ice cube storage bin is included in module 86 suitable cooling arrangements can be included to maintain the ice cube storage bin below 0° C. Examples of a cooling arrangement for an ice storage bin on a refrigerator compartment door are described in U.S. patent application Ser. No. 10/973,543, now U.S. Pat. No. 7,188,479, filed by Anselmino et al, which application is entirely incorporated by reference in this application. Dispenser module 86 can be provided with an insulated enclosure 96 to facilitate maintaining a below 0° C. temperature in module 86. Ice maker and storage module 142 can form an ice maker compartment in freezer compartment 56. Those skilled in the art will understand that the entire freezer compartment 56 can comprise the ice maker compartment and that the compartment housing the ice maker and ice cube storage bin can be eliminated if desired. In this embodiment, the ice maker and storage container module 142 is generally similar to a conventional freezer compartment ice making and storage device. An ice cube lifter 144 can extend from the freezer compartment 56 into the refrigerated compartment 54 to transport ice cubes from the ice maker and storage container 142 to the dispenser 72 on the refrigerator compartment door as hereinafter described. The ice cube lifter 144 is illustrated in FIG. 2 as comprising an insulated lifter conduit 146 incorporated into or installed to the insulated side wall 60 of the cabinet 52. The ice cube lifter conduit 146 can be suitably insulated and sealed to eliminate the flow of chilled air from the ice cube lifter 144 into the refrigerated compartment 54. Ice cube lifter 144 can have an outlet 148 for delivering ice cubes to dispenser inlet 98 when refrigerator compartment door 68 is closed. Those skilled in the art will readily understand that the dispenser control, not shown, can be arranged to operate only when refrigerator compartment door 68 is closed so that ice cubes delivered from outlet 148 can fall into dispenser inlet 98. The ice maker and storage module 142 can include a suitable mover (not shown) in the ice storage container to move ice cubes toward the ice cube lifter 144, or the ice cube storage container can be arranged to allow gravity feed of ice cubes to the ice cube lifter.

As is well-known in the art a water dispenser (not shown) can be integrated into the dispenser 72 so that, in addition to ice cubes, water, or a combination of both ice cubes and water can be selectively provided to a user. Suitable flexible connectors for water lines leading from a water valve 95 in the machinery compartment to the ice and water dispenser 72 can be provided to accommodate the movement of the door 68 between the open and closed positions.

Figure 3:
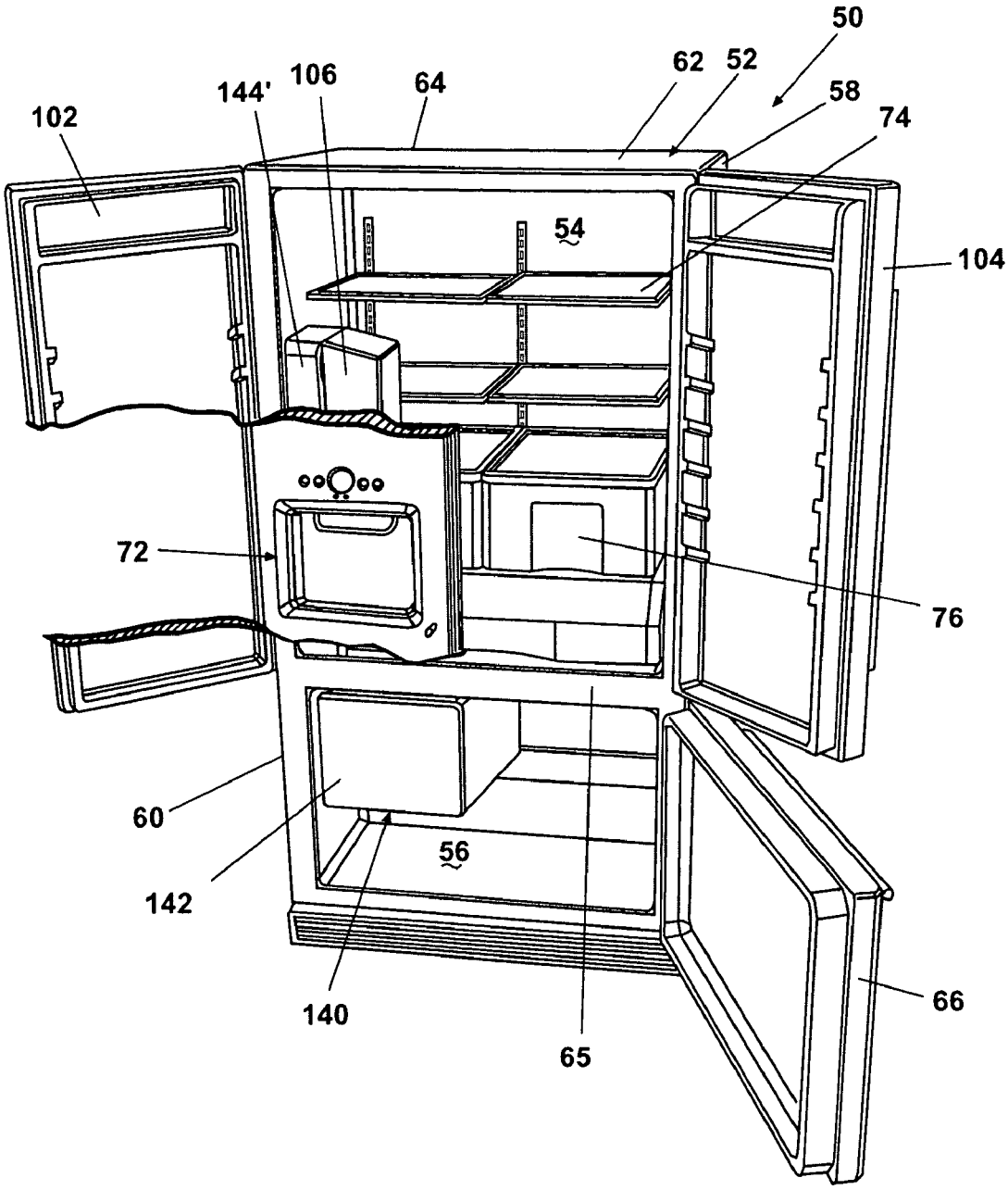
FIG. 3 is a perspective view similar to FIG. 1 illustrating another embodiment of freezer-mounted ice cube forming and dispensing apparatus and ice cube lifter according to the invention with another embodiment of refrigerator compartment door partially cut away to illustrate a through-the-door ice cube and water dispenser.

Referring now to FIG. 3, an alternate embodiment of a bottom-mount freezer refrigerator 50 is illustrated, which is similar to many respects to the embodiment illustrated in FIGS. 1 and 2. In this embodiment, a pair of refrigerator compartment doors 102 and 104 can be provided instead of a single door 68. An ice maker 140 can be mounted in the freezer compartment 56 as in the embodiment of FIGS. 1 and 2. Shelves 74 and one or more bins 76 can be provide in the refrigerator and/of the freezer compartment as is well-known in the art. An ice cube lifter 144' can be provided along and/or wholly or partially imbedded in side wall 60 as described above. In this embodiment, ice dispenser 72 can have a dispenser inlet 106 extending upward above dispenser 72 on the inside of refrigerator compartment door 102 to connect with ice cube lifter 144'. Dispenser inlet 106 can connect and seal to ice cube lifter 144' when refrigerator compartment door 102 is closed. Those skilled in the art will understand that suitable seals can be provided to facilitate sealing the outlet, not shown, of ice cube lifter 144' to dispenser inlet 106.

Figure 5:
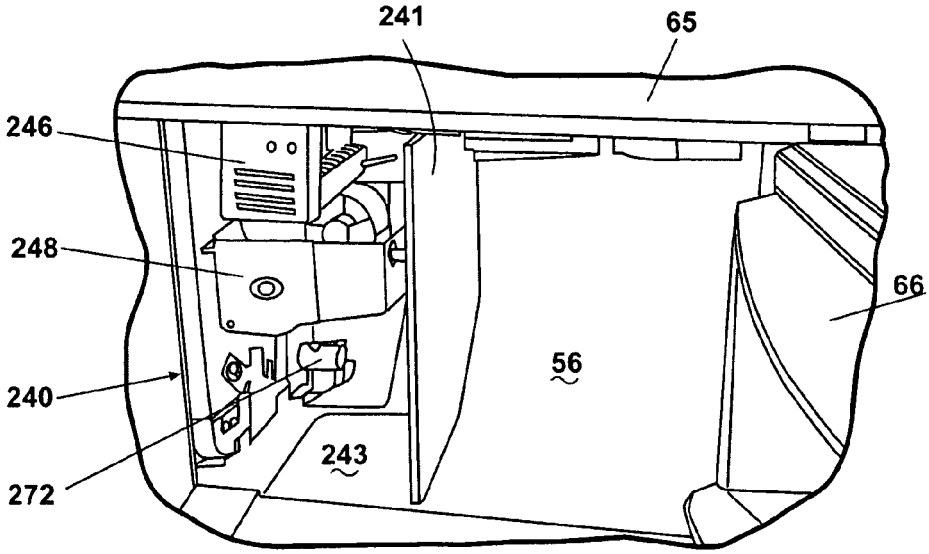
FIG. 5 is a partial perspective view of the bottom-mount freezer refrigerator of FIG. 1 and FIG. 2 illustrating one embodiment of a freezer-mounted ice maker, ice cube storage bin and dispensing apparatus positioned in the freezer compartment.
Figure 6:
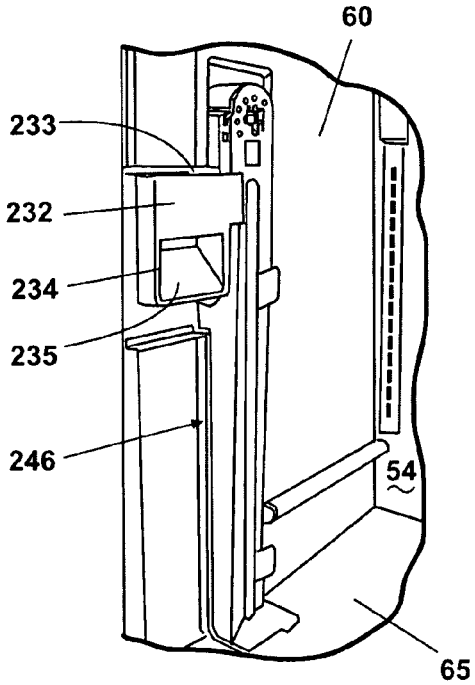
FIG. 6 is a partial perspective view of the bottom-mount freezer refrigerator of FIG. 1 and FIG. 2 illustrating the ice lifter apparatus in the refrigerator compartment.
Figure 7:
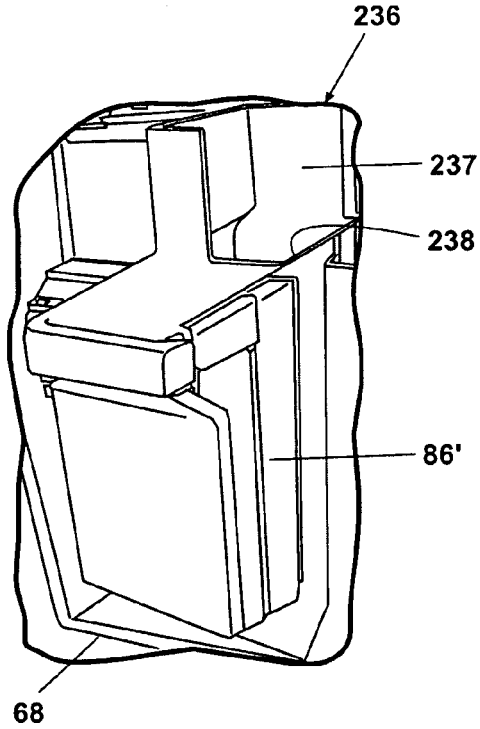
FIG. 7 is a partial perspective view of the bottom-mount freezer refrigerator of FIG. 1 and FIG. 2 illustrating the inside of the refrigerator compartment door and the connection of the ice lifter apparatus to the ice dispenser on the refrigerator compartment door.
Figure 8:
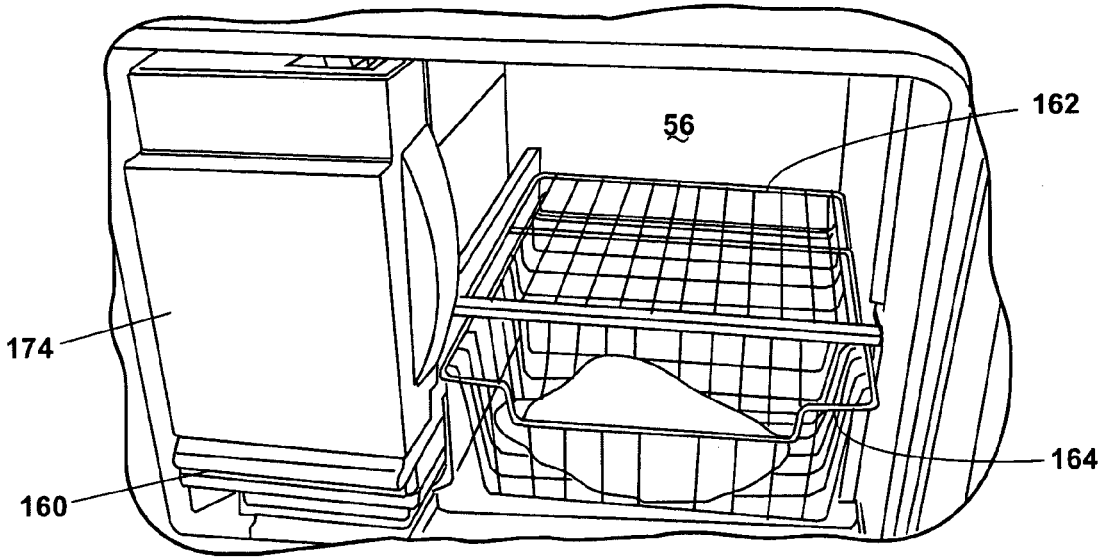
FIG. 8 is a partial perspective view of the bottom-mount freezer refrigerator of FIG. 4 illustrating another embodiment of a freezer-mounted ice maker, ice cube storage bin and dispensing apparatus positioned in the freezer compartment.
Figure 12A:
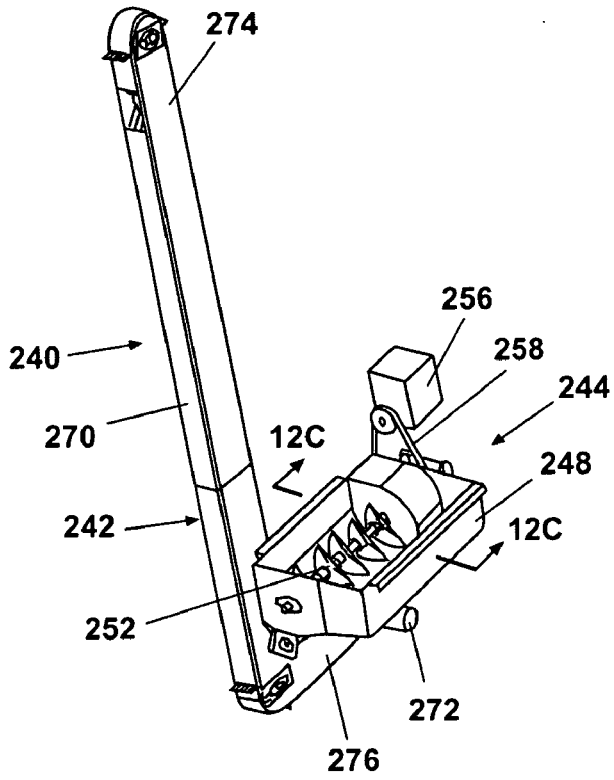
FIG. 12A is a first perspective view of a conveyor belt lifting apparatus for lifting ice cubes from a freezer-mounted ice cube forming apparatus to a refrigerator-mounted dispenser.

Referring to FIGS. 5 to 7, a bottom-mount refrigerator 50 having an alternate embodiment of ice cube lifter is illustrated. Freezer compartment 56 can have an ice cube maker 246 positioned above an ice cube storage bin 248. A wall 241 can be provided to separate ice maker 246 and ice cube storage bin 248 from the remainder of freezer compartment 56 and can form ice maker compartment 243. A vertical belt ice cube lifter 240 can be seen positioned adjacent ice maker compartment 243 along the side wall of freezer compartment 56 extending through compartment separator 65 into refrigerator compartment 54. Vertical belt ice cube lifter 240 can include an outlet 292 (FIGS. 12A and 12G) and an ice cube lifter outlet chute 232 positioned along side wall 60 of the refrigerator compartment 54. Outlet chute 232 can include an outlet chute inlet 233 that can be positioned adjacent outlet 292 so that ice cubes exiting vertical ice cube lifter 240 can fall into outlet chute 232. Outlet chute 232 can include an outlet 234 at the end of outlet chute slide 235. Ice cubes falling into outlet chute 232 can freely fall onto outlet slide 235 and slide toward outlet 234. Dispenser module 86' can be positioned on refrigerator compartment door 68 and can include dispenser inlet chute 236 that can be secured to the top of dispenser module 86' overlying the dispenser inlet, not shown. Dispenser module 86' can be in operable communication with dispenser 72 described above. Inlet chute 236 can include an inlet 237 and an inlet chute slide 238 leading down to the dispenser inlet. As can be seen by referring to FIGS. 6 and 7, outlet chute outlet 234 and inlet chute inlet 237 can be arranged to form a substantially closed chute leading from vertical belt ice cube lifter 240 to dispenser 86' inlet, not shown, when refrigerator compartment door 68 is closed. Operation of vertical belt ice cube lifter 240 is described in greater detail below in connection with the description of FIGS. 12A to 12 I.

Referring to FIGS. 4 and 8 to 11, a bottom-mount freezer refrigerator 50 can be seen. Bottom-mount freezer refrigerator 50 can have a refrigerator compartment door 168 that can have an ice and water dispenser 172 positioned on the door generally similar to dispenser 72 described above, and that can include a dispenser outlet, not shown. Bottom freezer refrigerator 50 can also have a freezer compartment door 166. Ice and water dispenser 172 can include an ice dispenser paddle 200 and a water dispenser paddle 206. When ice dispenser paddle 200 and water dispenser paddle 206 are operated by a user such as by pressing a glass against the desired paddle, the ice and water dispenser control (not shown) can cause dispensing of ice cubes or water as is well known in the art. Another embodiment of an ice making and dispensing apparatus 174 according to the invention can be positioned in freezer compartment 56 having a portion extending up into refrigerator compartment 54. Freezer compartment 56 can include a shelf 162 and a basket 164. An additional storage basket 160 can be slideably mounted under ice making and dispensing apparatus 174 for storage of frozen juice cans and the like. Those skilled in the art will understand that shelves 74 and bins 76 described above can be used in refrigerator compartment 54 and freezer compartment 56 if desired.

Figure 11A:
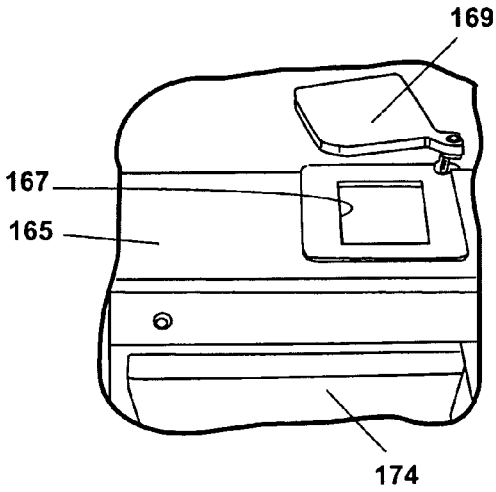
FIG. 11A is a partial perspective view of the bottom-mount freezer refrigerator of FIG. 8 illustrating the ice lifter apparatus passage through the compartment separator with the closure open.
Figure 11B:
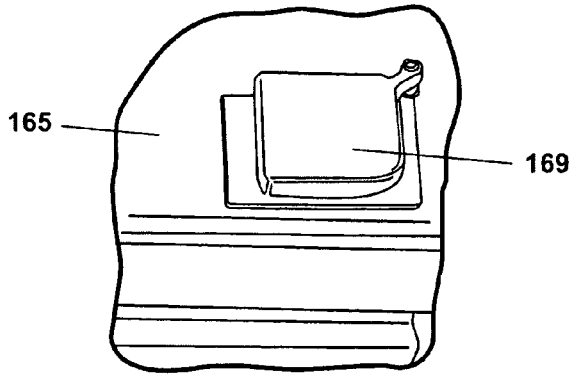
FIG. 11B is a partial perspective view of the bottom-mount freezer refrigerator of FIG. 8 illustrating the ice lifter apparatus passage through the compartment separator with the closure in the closed position.

Ice making and dispensing apparatus 174 can include an ice maker 176 and an accelerator 173 for propelling ice cubes from an ice cube storage bin 178 to dispenser 172. Accelerator 173 can include an accelerator wheel housing 175 that can be a volute, enclosing an accelerator wheel 186. Ice making and dispensing apparatus 174 can comprise an ice making compartment including an ice maker 176 and ice cube storage bin 178. Accelerator wheel housing 175 can transition into a generally upwardly directed conduit 171 that can have an outlet 191 adjacent compartment separator 165. A passage 167 can be provided in compartment separator 165 to provide a passage between the freezer compartment 56 and refrigerator compartment 54 that can connect conduit 171 with an upper conduit 188. As shown in FIGS. 11A and 11B passage 167 can have a passage door 169 that can be pivotally mounted to compartment separator 165. Passage door 169 can be arranged to selectively open and close accelerator passage 167 as shown in FIGS. 11A and 11B. Passage door 169 can be arranged to be spring loaded to allow door 169 to close as shown in FIG. 11B when refrigerator compartment door 168 is open and to open as shown in FIG. 11A when refrigerator compartment door 168 is closed. Those skilled in the art will understand that passage door 169 can be arranged to be operated by refrigerator compartment door 168 or by other operating elements including a solenoid or a wax motor, both not shown. Also, passage door 169 can be arranged to be opened by operation of the ice dispenser paddle 200 when the dispenser is activated to limit the amount of time passage door 169 is open to allow below 0° C. air from freezer compartment 56 to migrate into refrigerator compartment 54.

Figure 9:
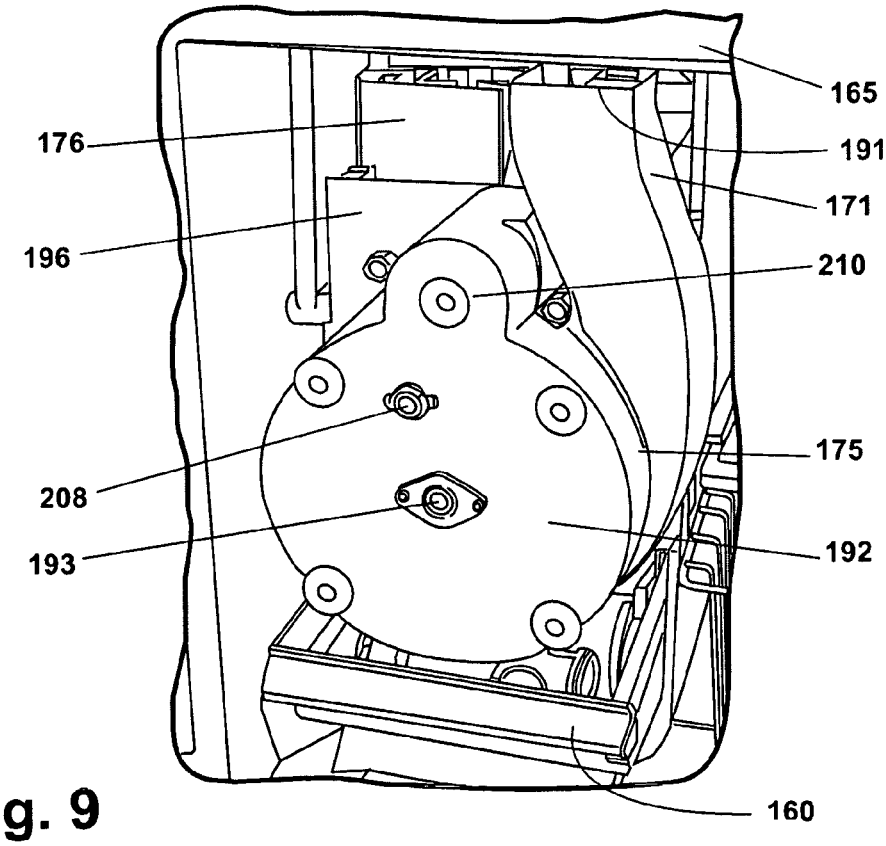
FIG. 9 is a partial perspective view of the bottom-freezer refrigerator of FIG. 8 illustrating the ice lifter apparatus positioned in the freezer compartment.
Figure 9A:
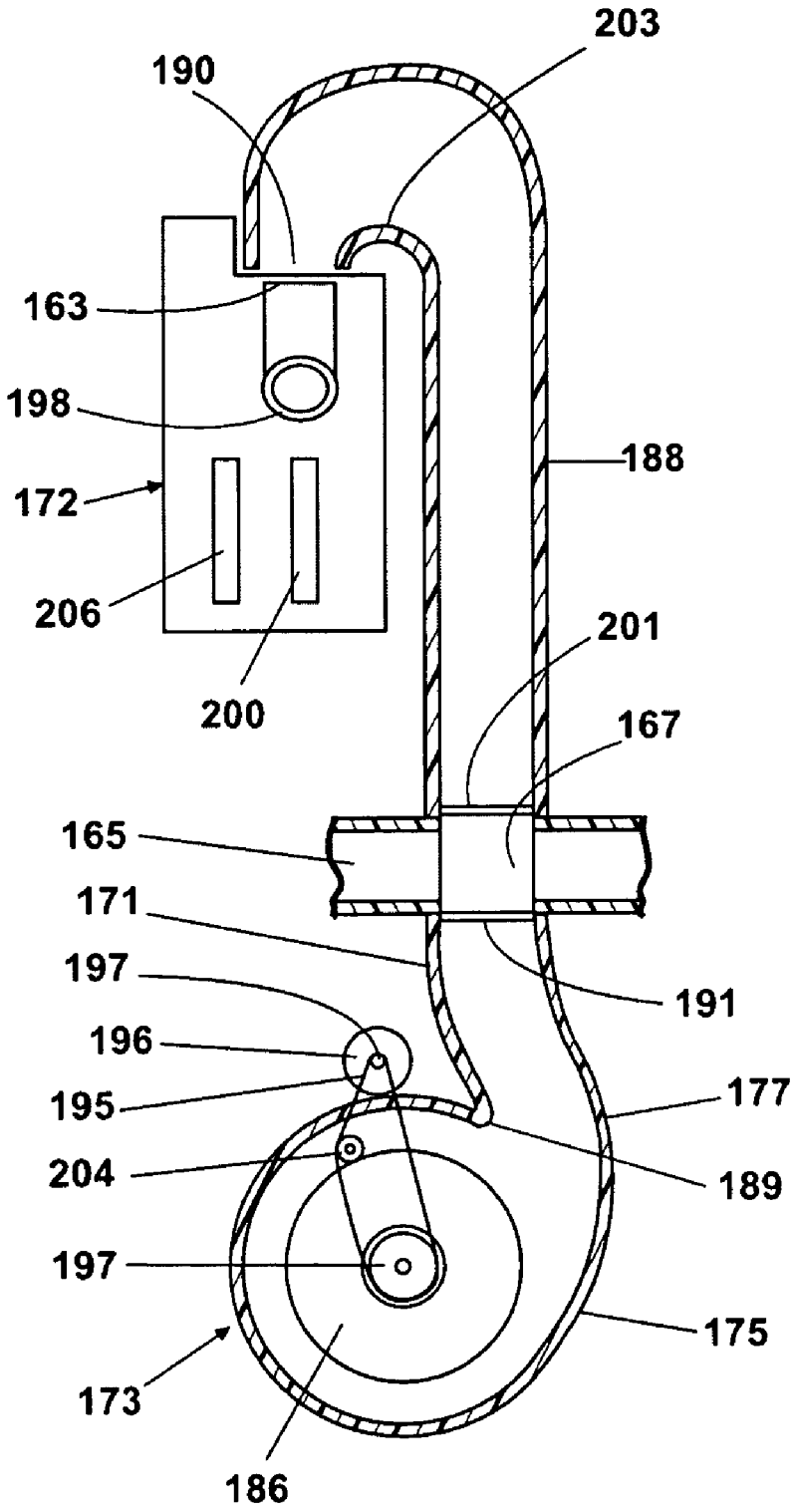
FIG. 9A is a schematic sectional front view illustrating the ice lifter apparatus of FIG. 8.
Figure 9B:
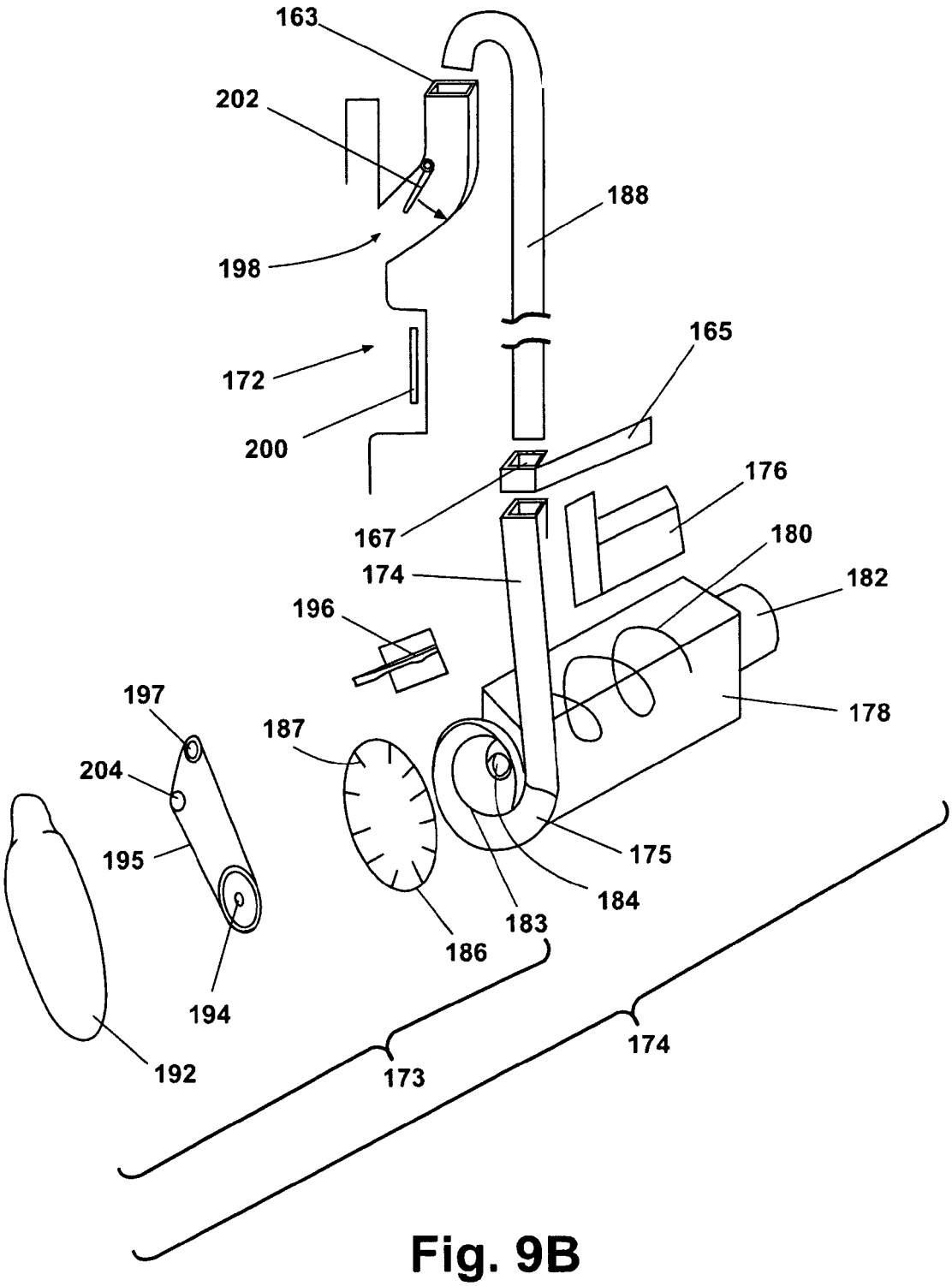
FIG. 9B is an exploded side view illustrating the ice lifter apparatus of FIG. 8.
Figure 10:
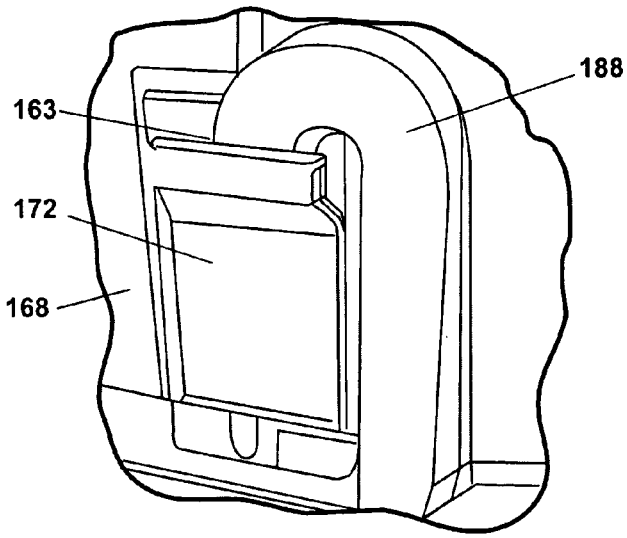
FIG. 10 is a partial perspective view of the bottom-mount freezer refrigerator of FIG. 4 illustrating the inside of the refrigerator compartment door and the connection of the ice lifter apparatus to the ice dispenser on the refrigerator compartment door.

Upper conduit 188 can be arranged on the inside of refrigerator compartment door 168. Dispenser 172 can include a dispenser outlet 198 and can be generally similar to dispenser 72 described above. Upper conduit 188 can lead from accelerator passage 167 in the compartment separator 165 to dispenser 172 and dispenser inlet 163 as can be seen in FIGS. 9A, 9B and 10. Upper conduit 188 can include an inlet 201 adjacent compartment separator 165 and can be positioned in line with accelerator passage 167 and accelerator conduit 171 when refrigerator compartment door 168 is closed. Upper conduit 188 can also include a conduit outlet 190 adjacent dispenser inlet 163. Thus, accelerator housing 175, conduit 171, compartment separator passage 167 and upper conduit 188 can form a substantially continuous passageway from accelerator wheel 186 to dispenser inlet 163 for ice cubes propelled by accelerator wheel 186. As above, dispenser 172 can be any well known ice or ice and water dispenser as used on side by side refrigerator freezers or as described in U.S. Pat. No. 4,084,725 to Buchser, U.S. Pat. No. 4,176,527 to Linstromberg et al, U.S. Pat. No. 4,942,979 to Linstromberg et al and U.S. Pat. No. 6,082,130 to Pastryk et al identified and incorporated by reference above. Ice and water dispenser 172 can have an ice cube dispenser outlet 198 and an ice dispenser paddle or actuator 200. Ice dispenser paddle 200 can be arranged to open an ice dispenser door 202 that can be arranged to close the ice cube passage to substantially prevent the escape of refrigerated air except when dispensing ice cubes as is well known in the art. Similarly, such through-the-door dispensers typically include a water dispenser that can include a water dispenser outlet, not shown, and a water dispenser paddle 206 to activate the water dispensing apparatus.

Referring to FIGS. 9, 9A, 9B and 9C accelerator 173 can include accelerator housing 175 that can be mounted at the front of ice cube storage bin 178. Accelerator housing 175 can include a central opening 183 that can be aligned with ice cube bin outlet 184 that can be positioned in the front wall of the ice cube storage bin 178. Ice cube storage bin 178 can include a mover for moving ice cubes in the ice cube storage bin 178 forward. The mover can be an auger 180 that can be rotatably mounted in ice cube storage bin 178 and arranged to move ice cubes forward in the ice cube storage bin 178 when auger 180 is operated. Auger 180 and be operatively connected to an auger motor 182. When auger motor 182 is activated by pressing on the ice dispenser paddle 200, auger 180 rotates moving ice cubes forward in ice cube storage bin 178 and out through ice cube bin outlet 184. Ice cubes exiting ice cube bin outlet 184 can fall into accelerator 186 to be propelled by accelerator 186 out of accelerator housing 175 through conduit 171, passage 167 in compartment separator 165 and upper conduit 188 and into dispenser 172.

Accelerator wheel 186 can be rotatably mounted in accelerator housing 175 and can be arranged to be driven by accelerator motor 196 via accelerator motor pulley 197, idler pulley 204, accelerator wheel drive belt 195 and accelerator drive pulley 194. An accelerator cover 192 can be provided to close accelerator housing 175. Accelerator cover 192 can support accelerator wheel bearing 193, idler pulley bearing 208 and accelerator motor bearing 210. Accelerator wheel bearing 193 can rotatable support accelerator wheel 186 in accelerator housing 175. Likewise, idler pulley bearing 208 can support idler pulley 204 in accelerator housing 175. Motor shaft bearing 210 can support the end of the motor shaft (not shown) on which accelerator motor pulley 197 is attached. Those skilled in the art will understand that accelerator wheel 186 can be arranged to be coupled to a motor in other well known operating arrangements. Accelerator wheel 186 can be arranged to rotate at 500 to 3500 rpm to reliably propel ice cubes from accelerator housing 175 to ice dispenser 172. Accelerator motor 196 and auger motor 182 can be arranged to be operably supported adjacent ice cube storage bin 178. Similarly, an ice maker 176 can be positioned above ice cube storage bin 178 and arranged to drop ice cubes harvested from the ice maker into the ice cube storage bin 178 as is well known in the art. Thus, when a user activates the ice dispenser 172 by pressing ice dispenser paddle 200, auger motor 182 can be energized to move ice cubes 185 into the center of accelerator wheel 186. Accelerator motor 196 can also be energized to cause accelerator wheel 186 to rotate.

Figure 9C:
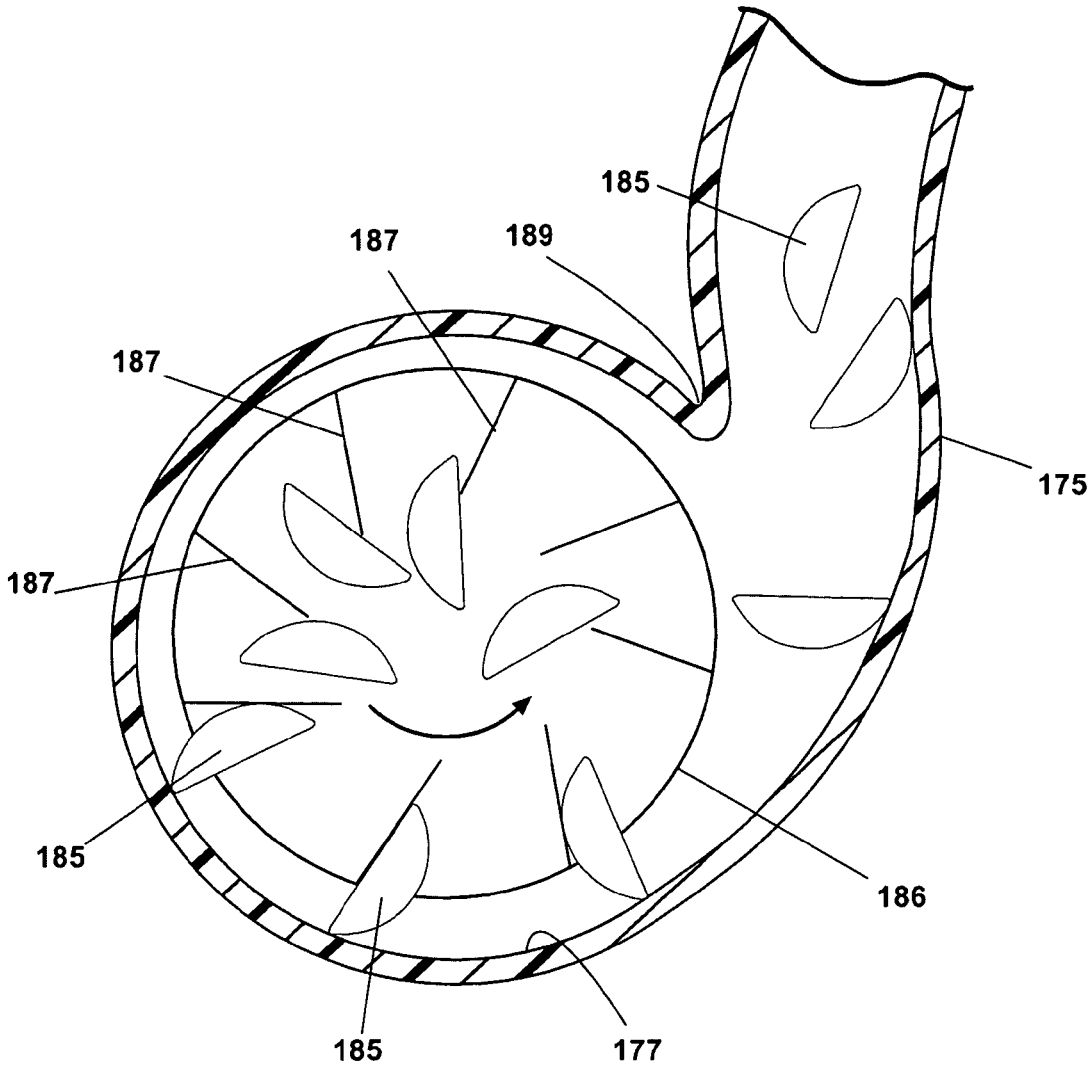
FIG. 9C is a schematic view of a portion of the ice lifter apparatus of FIG. 9.

As ice cubes fall into the center of accelerator wheel 186 they are contacted by blades 187. Blades 187 propel ice cubes 185 rotationally and radially against accelerator wheel housing inner wall 177 with sufficient energy to cause the ice cubes 185 to escape accelerator wheel 186 when there is sufficient space between accelerator wheel 186 and accelerator wheel housing 175 as illustrated in FIG. 9C. Blades 187 can be positioned generally radially on accelerator wheel 186, or as illustrated in FIG. 9C, at an angle from radial in the direction of rotation. Those skilled in the art will understand that the position of blades 187 on accelerator wheel 186 can be determined in order to achieve optimal performance in specific applications depending on parameters that can include system geometry and ice cube configuration among other parameters. As mentioned above, accelerator wheel housing 175 can take a volute shape around accelerator wheel 186 and define a widening gap between the accelerator wheel 186 and accelerator wheel housing inner wall 177 moving counter clockwise from cutoff 189. As ice cubes 185 are propelled off of accelerator wheel 186 the momentum and direction of discharge can cause the ice cubes 185 to move up through conduit 171 and upper conduit 188 and into dispenser 172. Ice cubes that fail to carry over the top 203 of upper conduit 188 can fall back into accelerator wheel 186 to again be propelled up to conduit 188. Alternately, accelerator conduit 171 can include a bypass, not shown, to direct ice cubes falling back into ice cube storage bin 178. Those skilled in the art will understand the ice cube storage bin 178 can be arranged to provide gravity feed of ice cubes stored in the storage bin to the inlet to the accelerator, although, use of a mover such as auger 180 can provide more certain dispensing of ice cubes.

In the embodiments described above, the ice cube storage bin has been shown positioned in the freezer compartment adjacent the ice maker. Those skilled in the art will understand that the ice cube storage bin can be located on the refrigerator compartment door combined with the ice dispenser as generally shown in U.S. Pat. No. 6,082,130 to Pastryk et al fully incorporated herein by reference. When the ice cube storage bin is positioned on the inside of the refrigerator compartment door those skilled in the art will readily understand that a supply of below 0° C. air or an auxiliary evaporator or other chilling mechanism can be provided to maintain ice cubes in the ice cube storage bin at below 0° C. temperatures.

Referring now to FIGS. 12A-I, a vertical conveyor belt lifter 240 is illustrated comprising a conveyor belt assembly 242 in cooperative register with an ice storage and delivery assembly 244. The ice storage and delivery assembly 244 can include a well-known ice maker 246 (FIG. 12C) for forming ice cubes 260, and an ice cube storage bin 248 positioned relative thereto for storing the formed ice cubes 260.

Figure 12B:
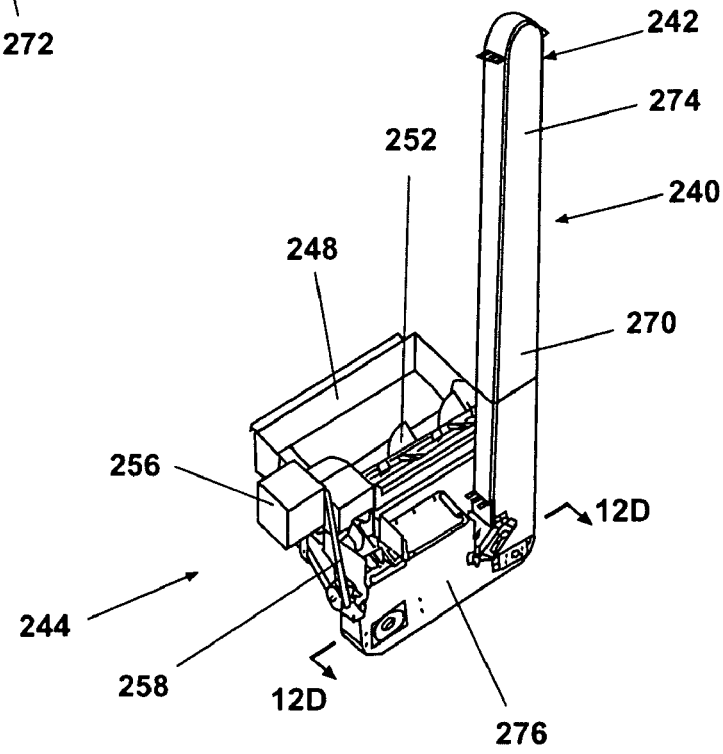
FIG. 12B is a second perspective view of the lifting apparatus illustrated in FIG. 12A.
Figure 12C:
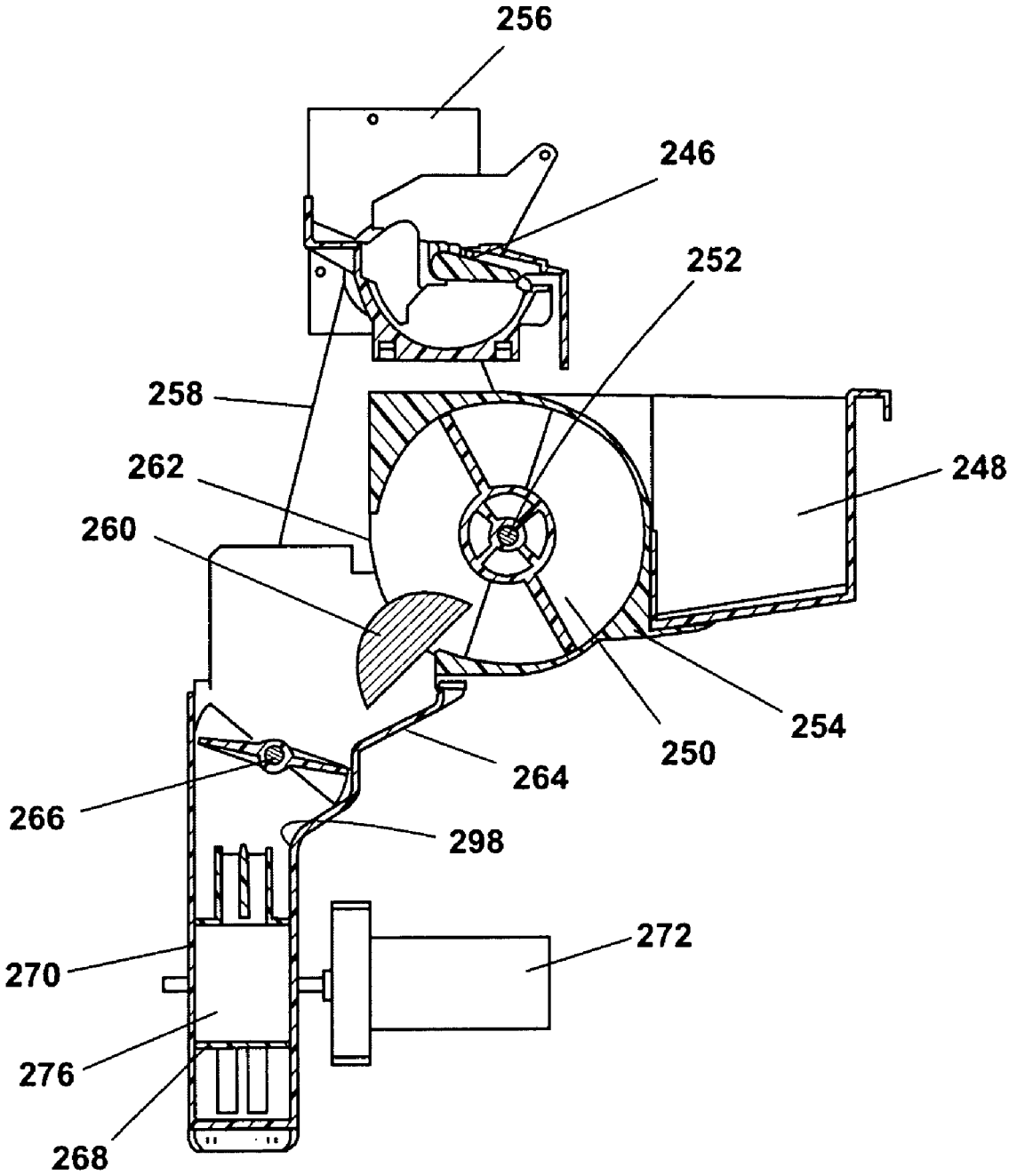
FIG. 12C is a sectional view taken along line 12C-12C of FIG. 12A.

An ice transfer assembly 250 can be operably connected to the ice cube storage bin 248 and can comprise an auger 252, positioned in ice cube storage bin 248. Auger 252 can be driven by an auger motor 256 connected to the auger 252 through a drive belt 258. The auger 252 can be adapted to move ice cubes 260 from the ice cube storage bin 248 to an auger bin outlet 262. The auger bin outlet 262 can be in communication with a dispenser enclosure 264 that can house a 3-blade dispensing auger 266. The dispensing auger 266 can be adapted to manipulate the ice cubes 260 in order to orient each ice cube 260 with a narrow, preferably rectilinear, slot 298 that can extend beneath the dispensing auger 266 and above a dispensing belt 268. The slot 298 can be arranged with its longitudinal axis parallel to the axis of the dispensing belt 268 to enable the passage of an ice cube therethrough having its longitudinal axis parallel to the axis of the dispensing belt 268. Dispensing auger 266 can be driven by auger motor 256 via drive belt 258, as illustrated in FIG. 12B.

Figure 12D:
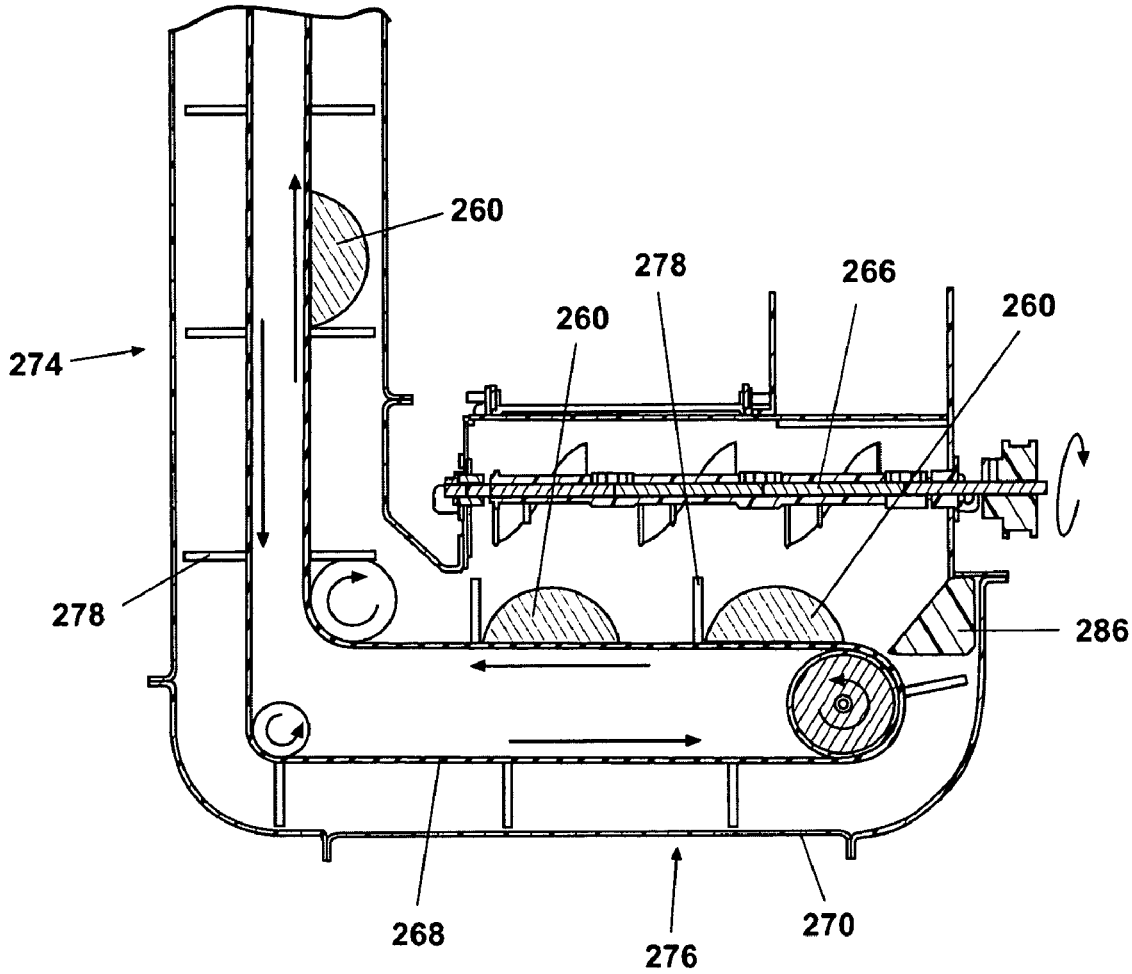
FIG. 12D is a sectional view taken along line 12D-12D of FIG. 12B.

Belt assembly 242 can comprise a dispensing belt 268 enclosed within a belt housing 270, and driven by a belt motor 272. As illustrated in FIGS. 12D and E, the belt assembly 242 can comprise a generally horizontal section 276 transitioning to a generally vertical section 274. The vertical section 274 can be adapted to extend from freezer compartment 56 to refrigerated compartment 54 to deliver ice cubes 260 to an ice and water dispenser 72 or a door-mounted storage container, not shown. Horizontal section 276 can be adapted to receive ice cubes 260 from the dispensing auger 266 for transport up the vertical section 274 to the ice and water dispenser 72. Ice and water dispenser 72 can have a dispenser outlet, not shown.

Figure 12E:
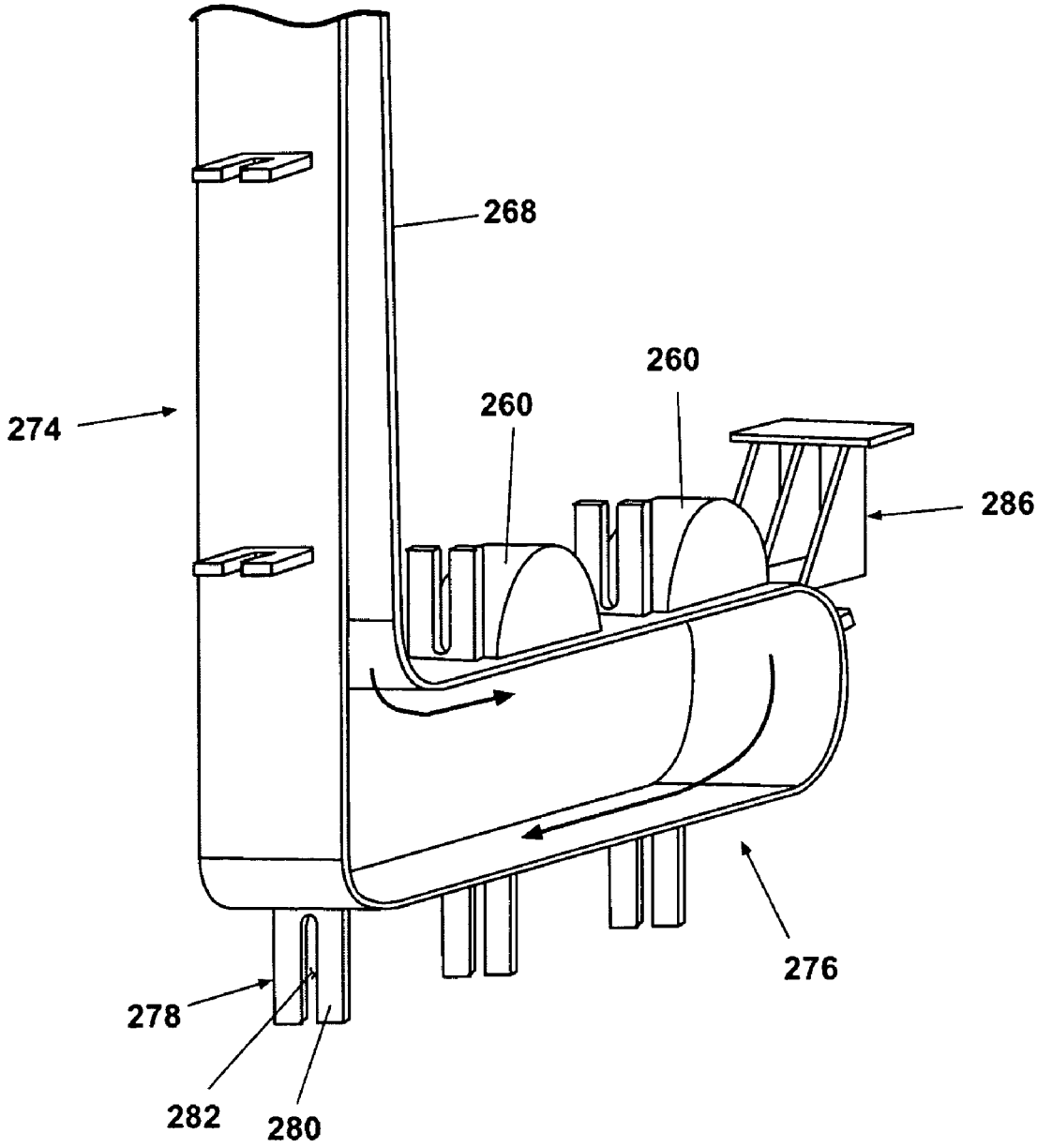
FIG. 12E is a perspective view of a portion of the conveyor belt illustrated in FIG. 12D illustrating a horizontal ice cube remover for removing ice cubes from the conveyor belt.
Figure 12F:
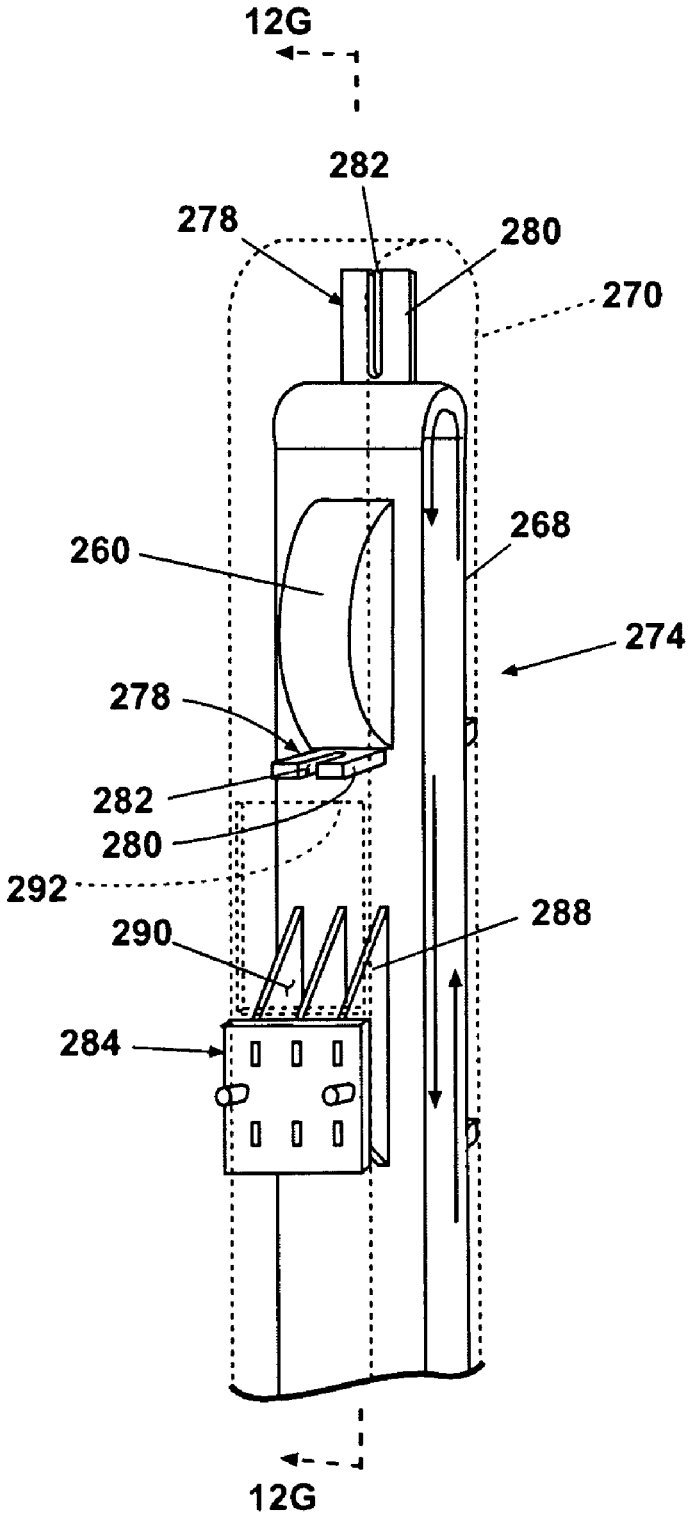
FIG. 12F is a perspective view of a portion of the conveyor belt illustrated in FIG. 12D illustrating a first embodiment of a vertical ice cube remover for removing ice cubes from the conveyor belt.

Referring specifically to FIGS. 12D-F, the dispensing belt 268 can be a flexible, continuous belt approximately the width of an ice cube 260 and comprising a suitable belt material, such as food grade urethane. The belt 268 can be provided with a plurality of lifting cleats 278 adapted to extend orthogonally outwardly for supporting ice cubes 260. The cleats 278 can be comprised of two or more cleat fingers 280 separated by a stripper space 282. The cleats 278 can be spaced along the belt 268 a distance somewhat greater than the length of an ice cube 260, and can have a length somewhat greater than the height of an ice cube 260. The belt 268 can be mounted to a plurality of suitably sized and oriented rollers for translation of the belt 268 along the horizontal and vertical directions.

The belt housing 270 can be somewhat wider than the width of the belt 268 to enable the unrestricted movement of the belt 268 therein. The clearance between the belt 268 and the belt housing 270 can be somewhat greater than the height of the lifting cleats 278. Each ice cube 260 can move through the belt housing 270 within a compartment defined by the belt 268, a pair of adjoining lifting cleats 278, and the housing 270. Thus, ice cubes 260 can be prevented from falling from the belt 268 or becoming lodged between the belt 268 and the housing 270.

Figure 12G:
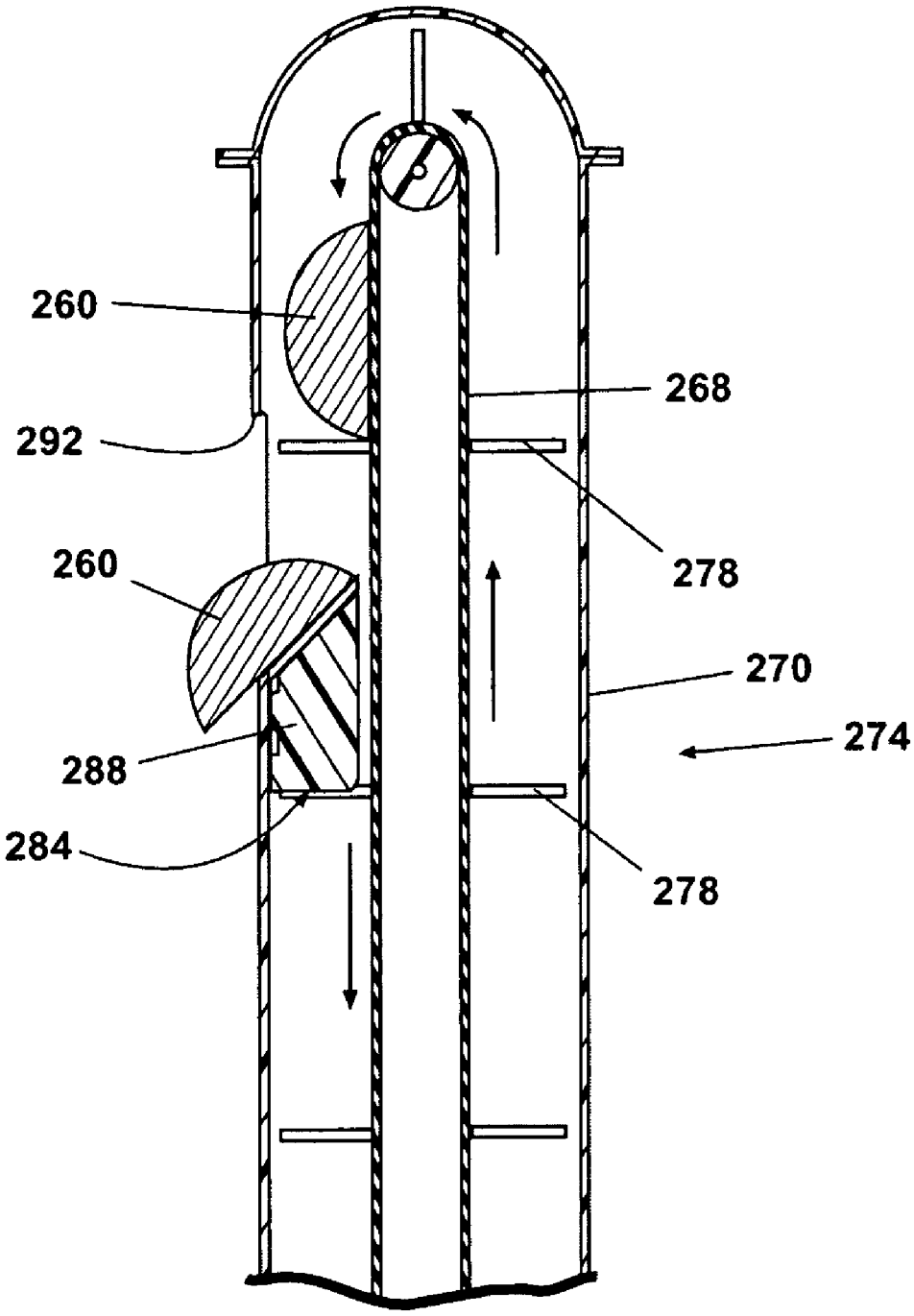
FIG. 12G is a sectional view taken along line 12G-12G of the portion of the conveyor belt illustrated in FIG. 12F.
Figure 12H:
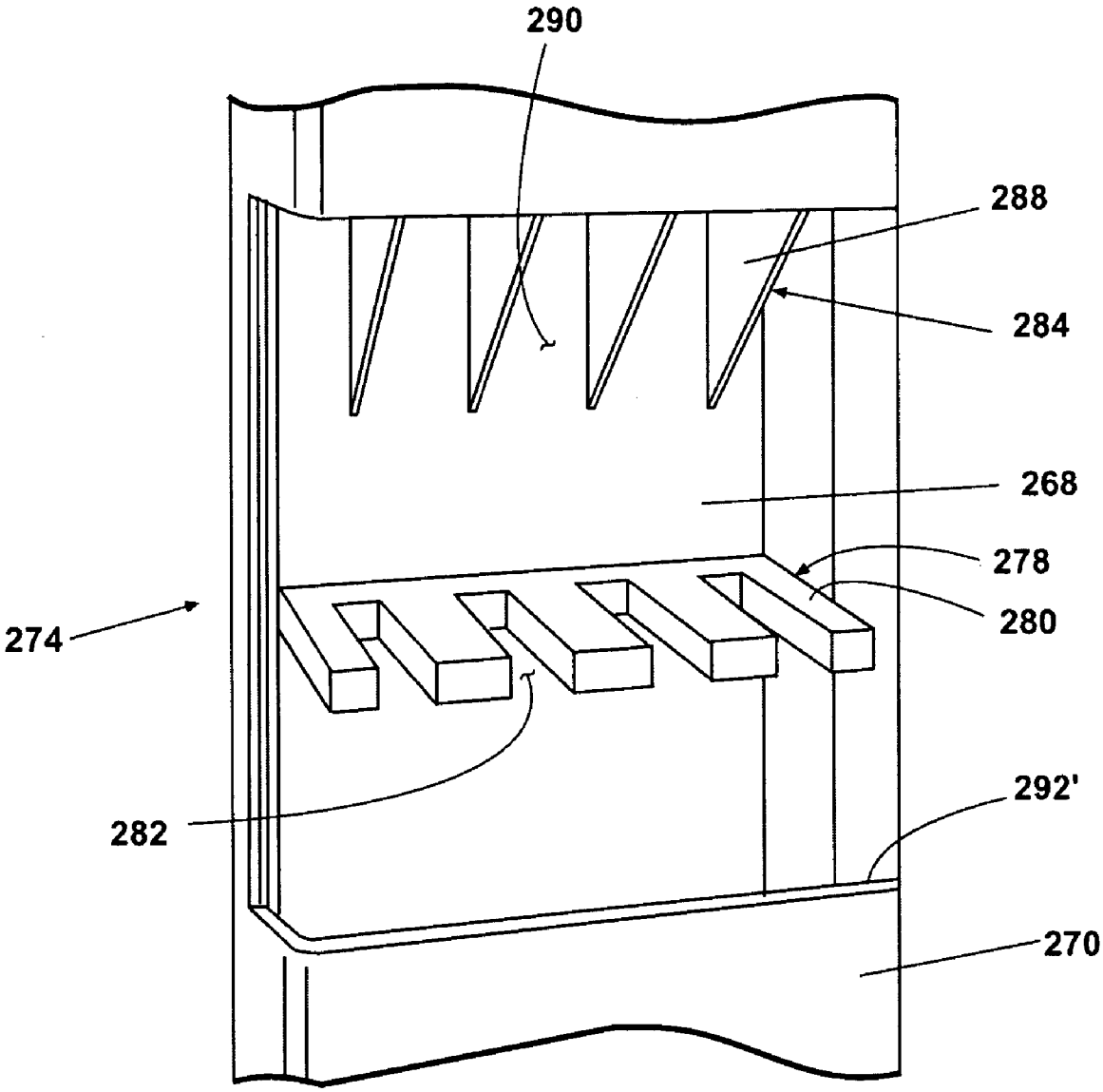
FIG. 12H is an enlarged perspective view of a second embodiment of a vertical ice cube remover for removing ice cubes from the conveyor belt.
Figure 12I:
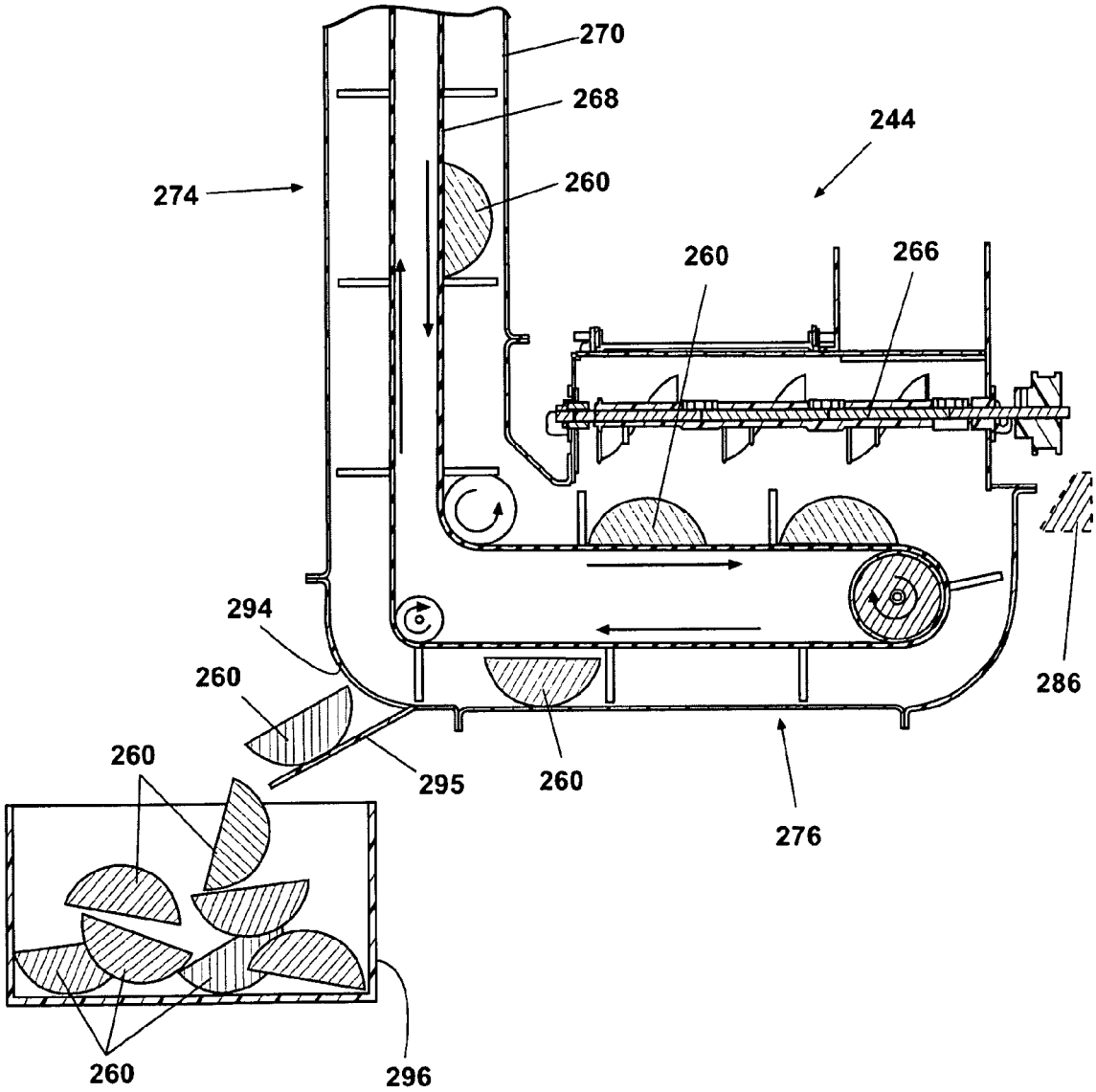
FIG. 12I is a sectional view similar to FIG. 12D illustrating an alternate dispensing arrangement.

An upper ice stripper 284 can comprise a plurality of triangular or wedge-shaped plates 288 fixed in a parallel, spaced-apart relationship co-linearly with the longitudinal axis of the belt 268. The spacing 290 of the plates 288 can be adapted to the width of the cleat fingers 280 to enable cleat fingers 280 to pass through the spaces 290 between adjacent plates 288. The angular or inclined edge of the plates 288 can be oriented against the movement of the belt 268 so that, when a cleat 278 carrying an ice cube 260 passes through the stripper 284, the plates 288 can strip an ice cube 260 laterally off the cleat 278 (FIG. 12G). An upper housing opening 292 can be provided in an upper portion of the vertical section 274 of the belt housing 270 for movement of the ice cubes 260 from the belt 268 to an ice and water dispenser 72. Thus, as illustrated in FIG. 12G, as the lifting cleats 278 move downwardly through the upper ice stripper 284 ice cubes can be removed through upper housing 292 to an ice and water dispenser 72. As illustrated in FIG. 12H, the upper ice stripper 284 can be oriented to remove ice cubes from the lifting cleats 278 through upper housing opening 292' as the lifting cleats 278 move upwardly through the upper ice stripper 284. The choice of selecting a discharge arrangement as illustrated in FIG. 12G or 12H can depend on the orientation of upper portion 274 and the arrangement of the inlet to the ice and water dispenser 72.

A lower stripper 286, similar in operational respects to the upper stripper 284, can be located adjacent the end of the horizontal section 276, as illustrated in FIG. 12D. The lower stripper 286 can remove ice cubes 260 from the horizontal section 276 when the belt 268 is operated in a reverse direction. At the end of a dispensing operation belt 268 can be operated in a reverse direction to remove ice cubes 260 remaining on conveyor belt 268 in refrigerator compartment 54 when the dispensing operation is completed. Ice cubes 260 removed from belt 268 by lower stripper 286 can accumulate in the space between belt 268 and dispensing auger 266. Those skilled in the art will understand that the space between belt 268 and dispensing auger 266 can be arranged to provide sufficient storage volume for ice cubes 260 remaining on belt 268 at the end of a dispensing operation. Lower stripper 286 can be movably positioned in belt housing 270 to allow movement out of horizontal section 276 (shown in dashed lines in FIG. 12I) and a lower housing opening 294 can be provided in the bottom of the housing enclosing the horizontal section 276 for ice cubes 260 to exit the vertical belt ice lifter 240 to a bulk storage container 296. Thus, to facilitate bulk removal of ice cubes from ice cube storage bin 248, lower stripper 286 can be withdrawn, a closure 295 for lower housing opening 294 can be opened and conveyor belt 268 operated in reverse to dispense ice cubes 260 into a bulk container 296, FIG. 12I. Those skilled in the art will understand that movement of lower stripper 286, opening of closure 295 and operation of conveyor belt 268 in the reverse direction can be accomplished by actuators, not shown, under control of a suitable controller, not shown, that can have a Bulk Dispensing option or setting. In this case closure 295 can be released when conveyor belt 268 is operated in reverse allowing closure 295 to open, or closure 295 can be resiliently biased closed and the presence of an ice cube 260 on closure 295 can be sufficient to cause closure 295 to open discharging the ice cube, see FIG. 12I.

In an alternative embodiment, not shown, the horizontal section 276 can be eliminated and an ice cube transporting device, such as a well-known auger, a separate conveyor belt, or a gravity-based device, can be used to transfer the ice cubes 260 from the ice maker 246 to the vertical section 274.

The belt housing 270 can be insulated and appropriately sealed to prevent the movement of chilled air from the freezer compartment 56 and the vertical belt ice lifter 240 to the refrigerated compartment 54. The belt housing 270 can alternately be installed in insulated side wall 60 of the cabinet 52. The upper housing opening 292 can cooperatively communicate with an inlet opening (not shown) in the ice and water dispenser 72 or a storage container when the door 68 is closed similar to the embodiment illustrated in FIGS. 6 and 7. An appropriate gasket assembly can seal the opening 292 to the inlet to eliminate the flow of chilled air from the vertical belt ice lifter 240 to the refrigerated compartment 54. Ice and water dispenser 72 can include a dispenser outlet as is well known in the art. Also, dispenser 72 could be positioned on a countertop, not shown, and used in conjunction with an undercounter ice maker as described below.

Figure 13A:
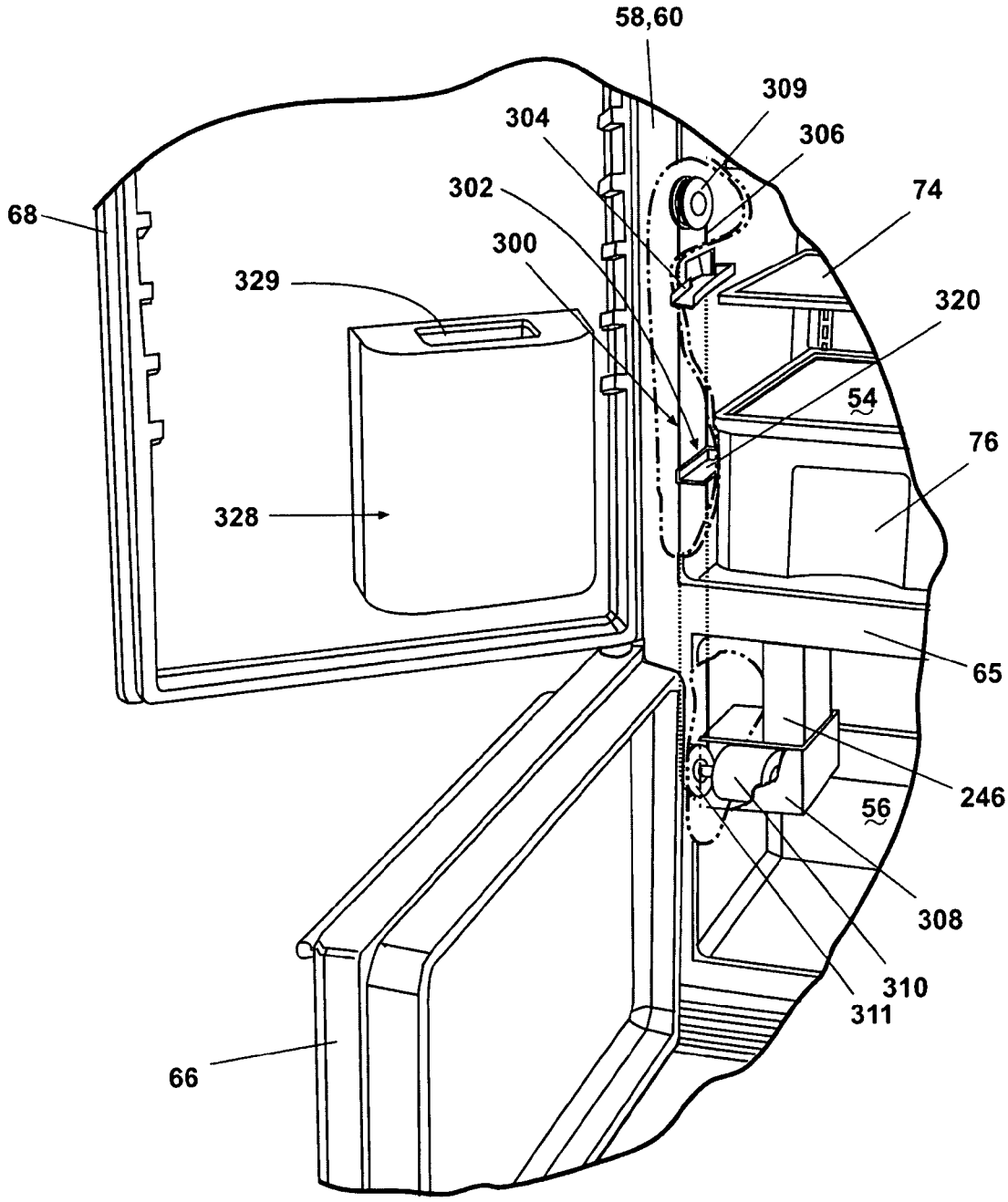
FIG. 13A is a partial perspective view of a bottom-mount refrigerator illustrating an elevator lifting apparatus for lifting ice cubes from a freezer-mounted ice cube forming apparatus to a refrigerator-mounted dispenser.

Another lifting mechanism in the form of an elevating platform ice lifter 300 is illustrated in FIGS. 13A and B for lifting ice cubes from the freezer compartment 56 to an dispensing module 328 in operable communication with a dispenser 72 that can be positioned on a refrigerator compartment door or on a countertop. An ice cube storage bin can be included in module 328 and can be provided with an ice crushing feature as described in the Pastryk et al patent as described above. Those skilled in the art will understand that the dispenser 72 can be arranged to deliver whole ice cubes, or can be arranged to selectively deliver whole or crushed ice cubes and/or water in response to activation of a selection control device (not shown) incorporated into the dispenser 72. If an ice cube storage bin is included in module 328 suitable cooling arrangements can be included to maintain the ice cube storage bin below 0° C. Examples of a cooling arrangement for an ice storage bin on a refrigerator compartment door are described in U.S. patent application Ser. No.

10/973,543, now U.S. Pat. No. 7,188,479, filed by Anselmino et al as described above. Elevating platform ice lifter 300 will be described in conjunction with a bottom freezer refrigerator, but could be used with an undercounter ice maker as described below. The elevating platform ice lifter 300 can comprise an elevating platform assembly 302 comprising a lifting platform 320 which can be incorporated in an elevator housing 326 that can be located adjacent to or in side wall 60. The elevator housing 326 can be similar to the conveyor housing in the embodiment of FIGS. 12A-12I. The embodiment illustrated in FIG. 13A elevating platform lifter 300 can comprise a continuous lifting cable 306 traveling around an upper pulley 309 and a lower pulley 311 and can be driven by a drive motor 310. The cable 306 can extend along the inside of the elevator housing 326 from the freezer compartment 56 to the refrigerated compartment 54. Lifting platform 320 can be attached to the cable 306 in order to raise and lower the lifting platform 320 as the cable 306 travels around the pulleys 309, 311. Other motor-driven lifting mechanisms can be utilized to accomplish the raising and lowering of a platform 320, for example a pole having a tracked portion along which a drive pinion can run to raise and lower the platform 320, a pair of lifting tracks mounted within the elevator housing and a pair of motor-driven pinions traveling along the tracks to raise and lower the platform 320, and the like. While one lifting platform is shown in the embodiment of FIGS. 13A and B, those skilled in the art will understand that more than one platform can be provided if desired.

Figure 13B:
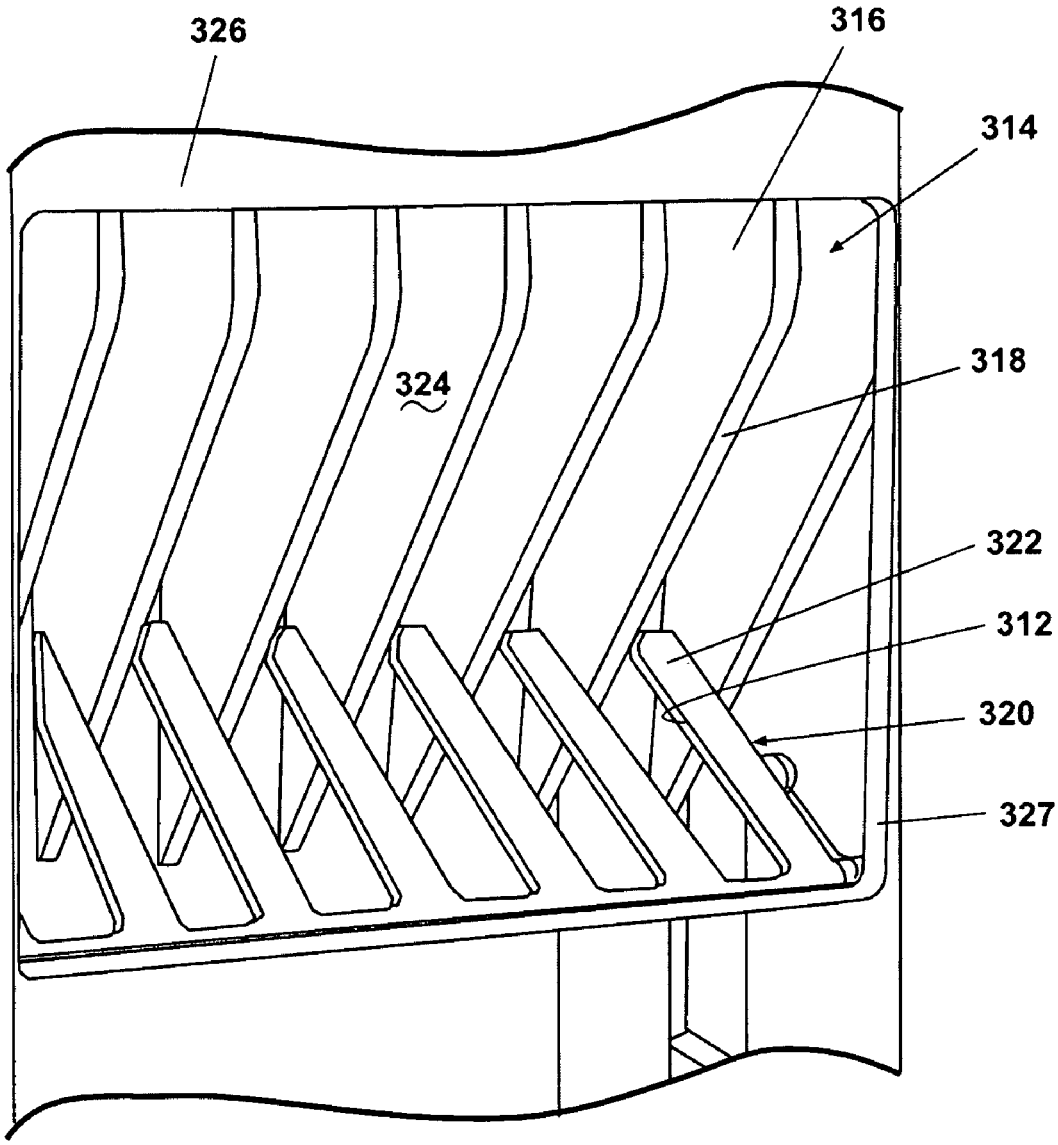
FIG. 13B is an enlarged view of an ice cube remover for removing ice cubes from the elevator lifting apparatus.

Ice cubes can be deposited onto the platform 320 from the ice maker 246 using a well-known delivery mechanism, for example by depositing the ice cubes directly from the ice maker onto the platform 320, delivering ice cubes to the platform 320 from a storage container 308 utilizing a conveyor belt or auger, gravity feed of ice cubes from the storage container 308, and the like. Ice cubes can be removed from the platform 320 to an inlet 329 in the module 328 by utilizing a slotted platform and stripper 314, illustrated in FIG. 13B, similar to the stripper 284 described with respect to FIGS. 12F-H. The platform 320 can be divided into fingers 322 separated by platform slots 312. Stripper 314 can be located adjacent dispensing module inlet 329 and can comprise a plurality of triangular or wedge-shaped plates 316 fixed in a parallel, spaced-apart relationship co-linearly with the longitudinal axis of the elevating platform assembly 302. Stripper 314 can be located partially in opening 327 in elevator housing 326. Each wedge plate can have an inclined face 318. The spacing 324 of the plates 316 can be adapted to the width of the platform fingers 322 to enable a platform fingers 322 to pass through the spaces 324 between adjacent plates 316. The platform slots 312 can be adapted for the passage of the stripper plates 316 therethrough. The angular or inclined edge 318 of the plates 316 can be oriented against the movement of the platform 320 so that, when an ice cube passes through the stripper 314, the plates 316 will urge the ice cube 260 laterally off the platform 320, though opening 327 and into the inlet 329. Alternately, stripper 314 can be eliminated if platform fingers 322 are inclined to allow ice cubes to fall or slide out of opening 327 into inlet 329. A chute 304 can be provided to carry ice cubes from opening 327 to dispenser inlet 329.

Elevating platform ice lifter 300 can be enclosed within a suitable insulated enclosure 326 (illustrated in outlined form in FIG. 13A) in the refrigerated compartment 54. This can comprise an enclosure 326 that can be mounted to side wall 60 extending into the refrigerated compartment 54 and freezer compartment 56, or the lifter 300 can be installed in side wall 60 within the side wall insulation. Suitable flaps or doors can be provided to seal an ice cube discharge outlet 327 from the lifter 300 and the inlet 329 to prevent the flow of chilled air from the lifter 300 into the refrigerated compartment 54. Those skilled in the art will understand that chute 304 can be open as illustrated in FIG. 13A or, if desired, can be an enclosed chute enclosing opening 327 in elevator housing 326. Chute 304 can be enclosed and can be arranged to provide a substantially continuous passage from opening 327 to dispenser inlet 329 when door 68 is closed. The substantially continuous passage can be used to convey below 0° C. air from freezer compartment 56 to module 328 if an ice cube storage bin is incorporated in module 328. A fan (not shown) can be provided in freezer compartment 56 to move below 0° C. air though lifter 300 to module 328. Those skilled in the art will understand that motor 310 can be provided with suitable controls arranged to drive platform 320 from a position adjacent ice maker 246 where ice cubes can be loaded on platform 320 to opening 327 where ice cubes can be stripped off platform 320 into dispenser inlet 329.

An alternate embodiment of an ice cube lifter is illustrated in FIGS. 14A-F comprising an auger ice lifter 330. As illustrated in FIGS. 14A-F, the auger ice lifter 330 can comprise a vertical auger assembly 332 and a horizontal auger assembly 334. The vertical auger assembly 332 can extend from the freezer compartment 56 into the refrigerated compartment 54 and can be adapted to transport ice cubes from the ice maker 246 to a dispenser 72. The vertical auger assembly 332 can comprise an auger 346 adapted for ice cube transport that can be driven by a suitable vertical drive motor 336. Auger 346 can be enclosed within a closely-fitting auger housing 342 to provide sufficient clearance between the auger 346 and the housing 342 to enable the auger 346 to rotate within the housing 342 but prevent ice cubes from moving between the auger 346 and the housing 342. Horizontal auger assembly 334 can comprise an auger 348 adapted for ice cube transport driven by a horizontal drive motor 338, and can be adapted for ice cube transport from the ice maker 246 to the vertical auger assembly 332. Auger 348 can be enclosed within a closely fitting auger housing 344 outside ice cube storage bin 248 to provide sufficient clearance between the auger 348 and the housing 344 to enable the auger 348 to rotate within the housing 344 but prevent ice cubes from moving between the auger 348 and the housing 344. Those skilled in the art will understand that housing 344 need not extend into ice cube storage bin 248. Horizontal auger 348 can operate openly in ice cube storage bin 248 to move ice cubes toward vertical auger 332. Horizontal auger assembly 334 can be replaced with an alternate ice cube transport assembly, for example an open auger as illustrated in U.S. Pat. No. 4,084,725 to Buchser and U.S. Pat. No. 4,942,979 to Lindstromberg et al. incorporated by reference above, a conveyor belt assembly, an inclined chute extending from the ice maker 246 to the vertical auger assembly 332 for gravity feed, and the like.

Figure 14A:
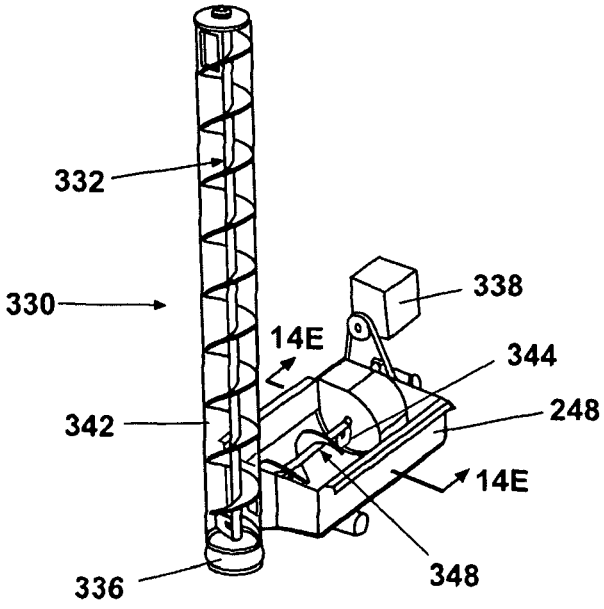
FIG. 14A is a first perspective view of an auger lifting apparatus for lifting ice cubes from a freezer-mounted ice cube forming apparatus to a refrigerator-mounted dispenser.
Figure 14B:
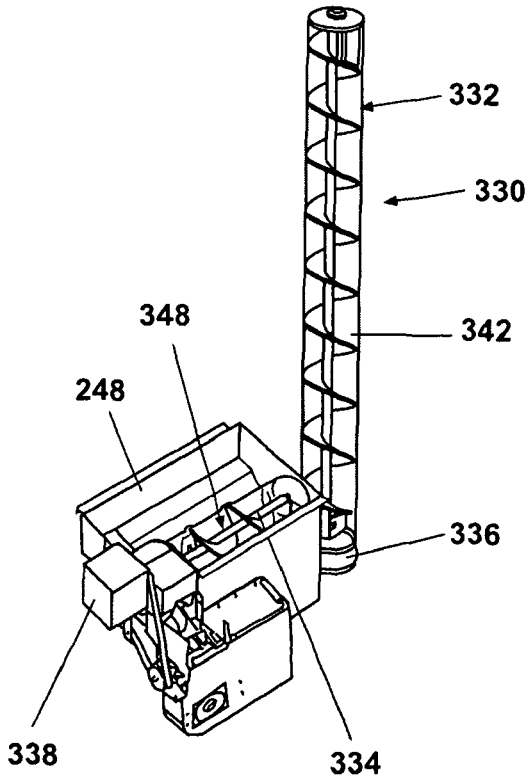
FIG. 14B is a second perspective view of the lifting apparatus illustrated in FIG. 14A.
Figure 14C:
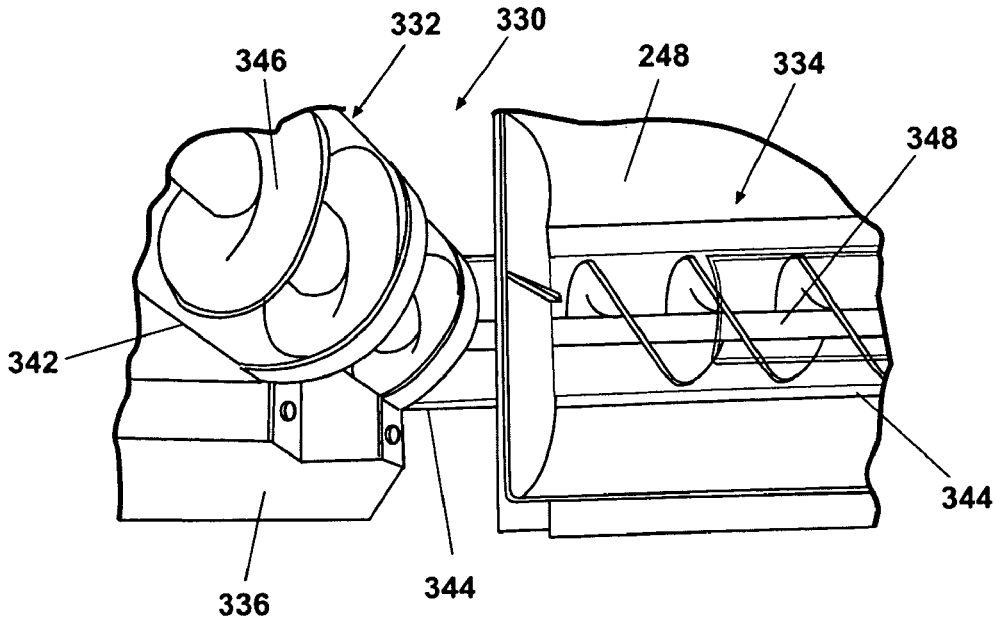
FIG. 14C is an enlarged perspective view of a portion of the lifting apparatus illustrated in FIG. 14A illustrating a vertical auger in cooperative register with a horizontal auger.
Figure 14D:
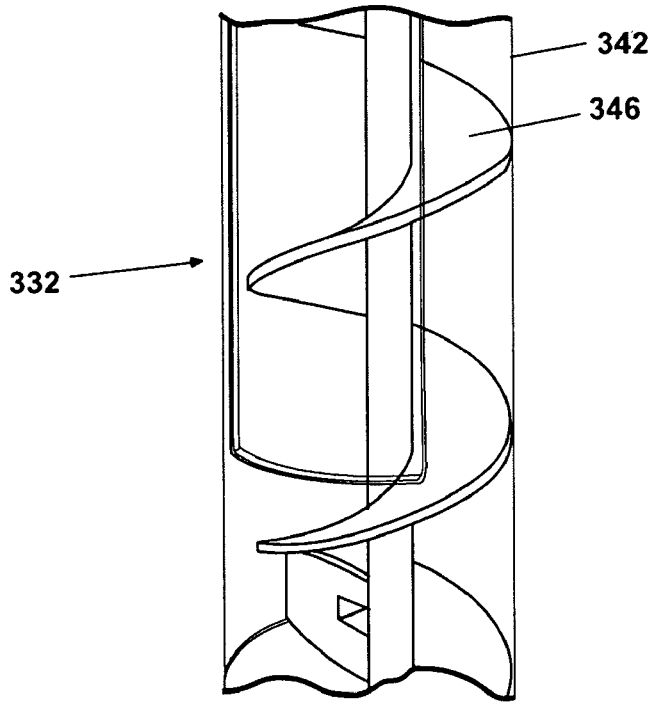
FIG. 14D is an enlarged perspective view of a portion of the vertical auger illustrated in FIGS. 14A-C.
Figure 14E:
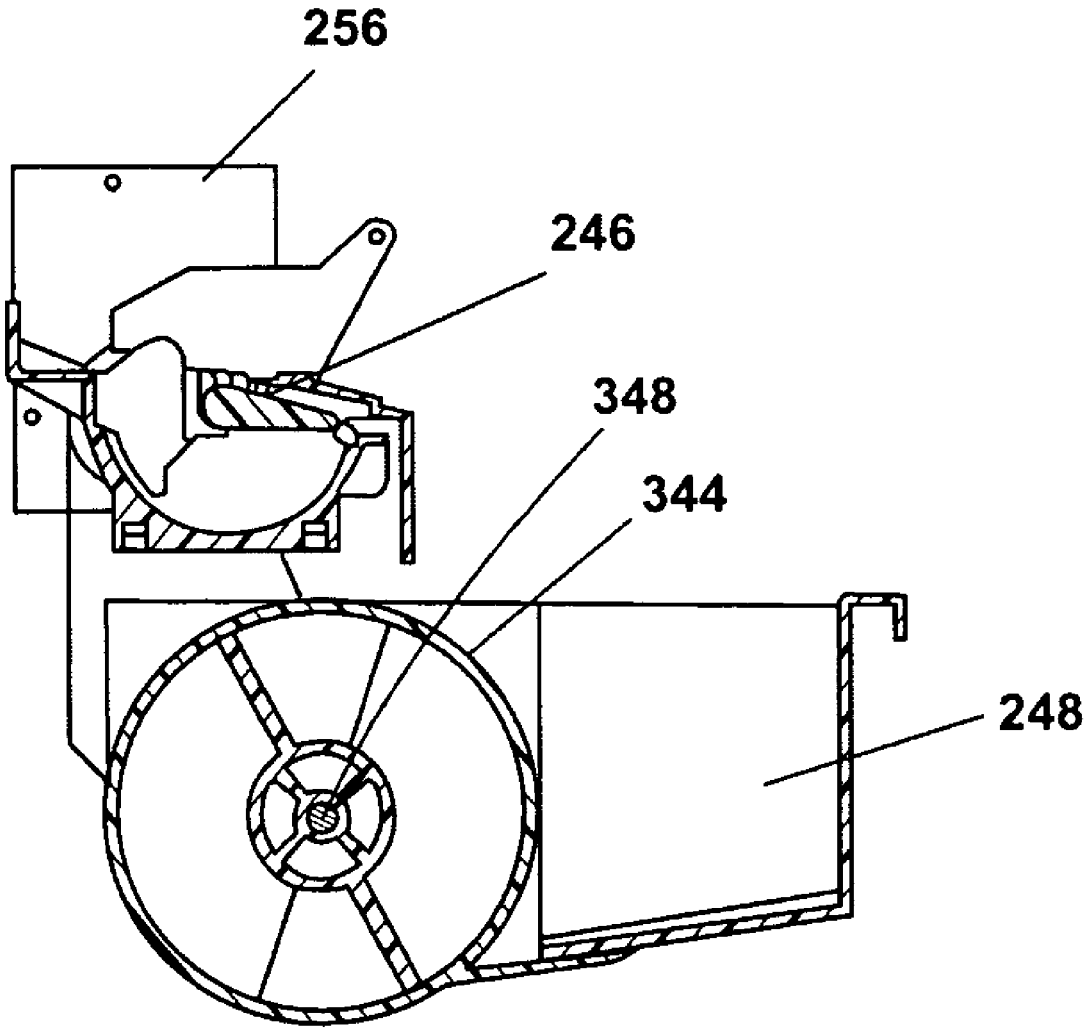
FIG. 14E is a sectional view taken along line 14E-14E of FIG. 14A.
Figure 14F:
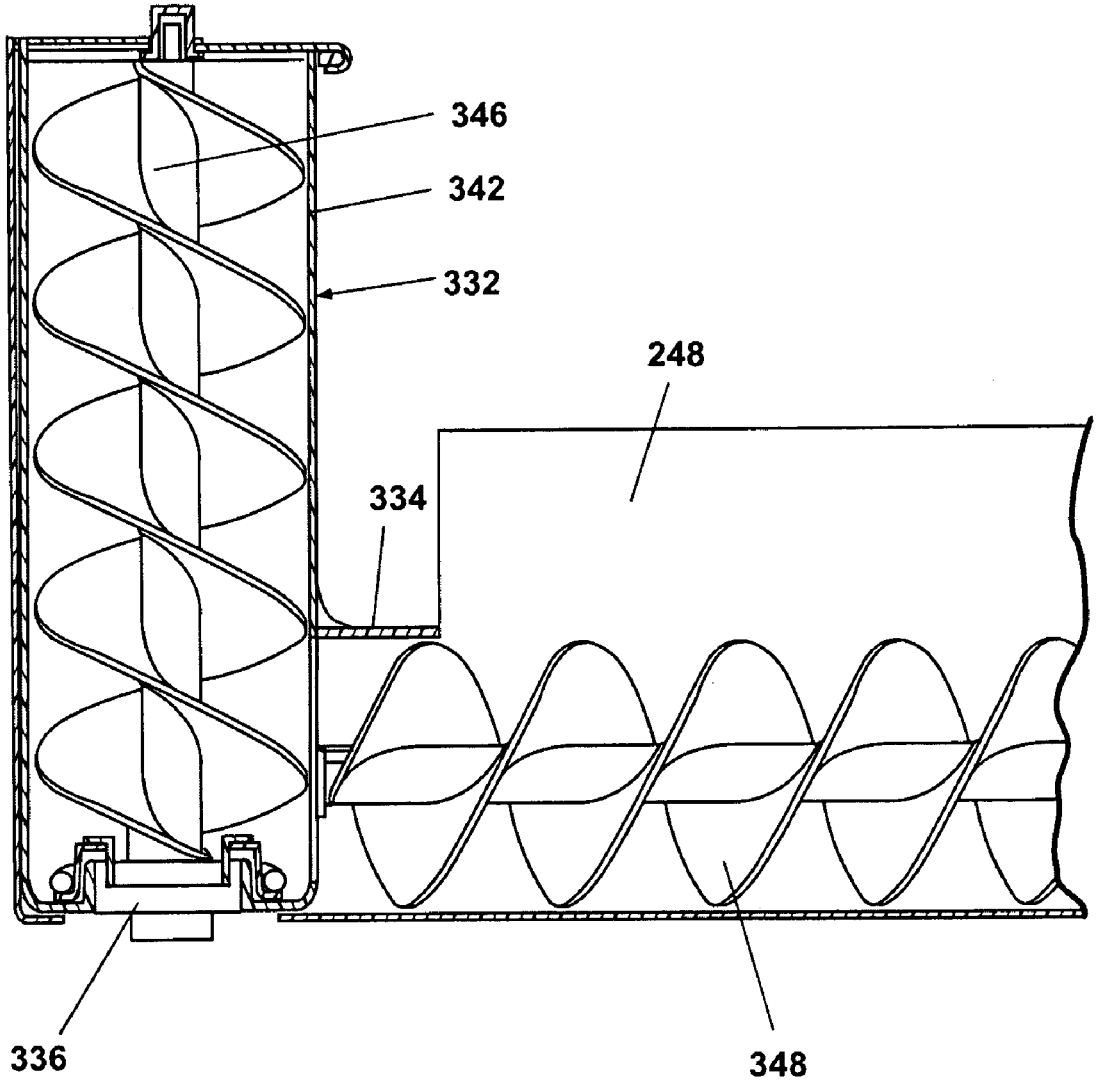
FIG. 14F is a plan view of a portion of the lifting apparatus illustrated in FIG. 14A illustrating the vertical auger and the horizontal auger with an auger enclosure partially removed for clarity.
Figure 15:
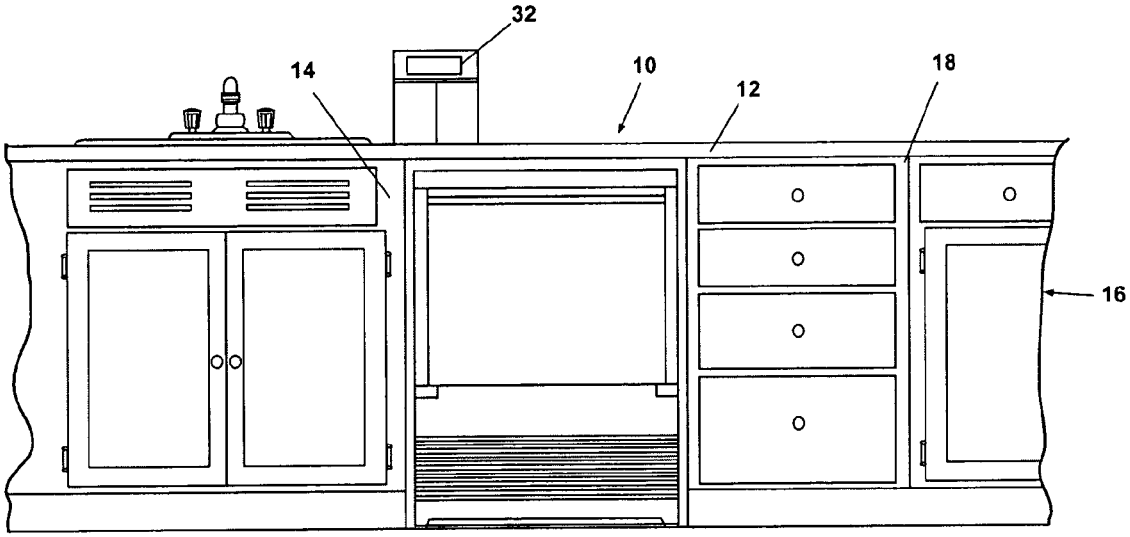
FIG. 15 is an illustration of one embodiment of an undercounter ice maker having a countertop ice dispenser and ice cube lifter apparatus according to the invention.
Figure 16:
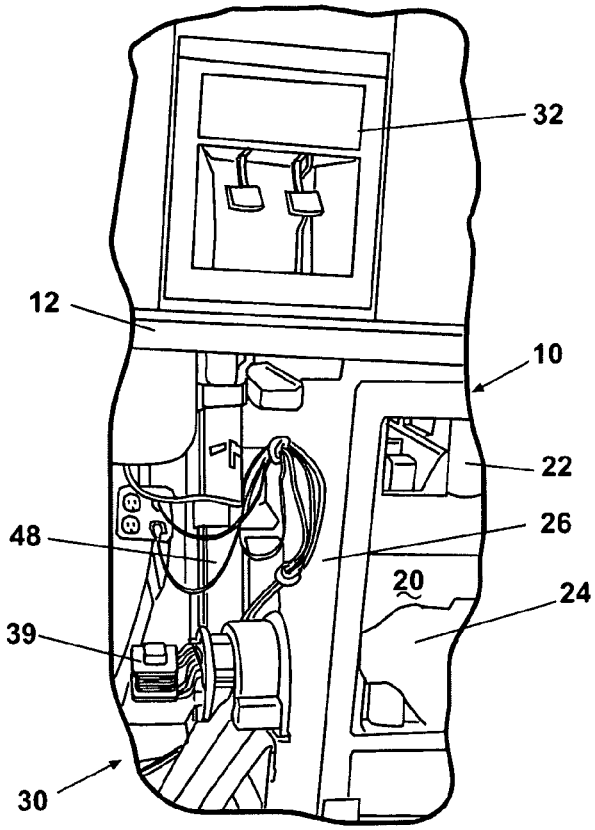
FIG. 16 is a partial perspective view of an embodiment of the undercounter ice maker and countertop ice dispenser of FIG. 15 illustrating the countertop ice dispenser, part of the interior of the ice maker and a portion of the ice lifter apparatus.
Figure 17:
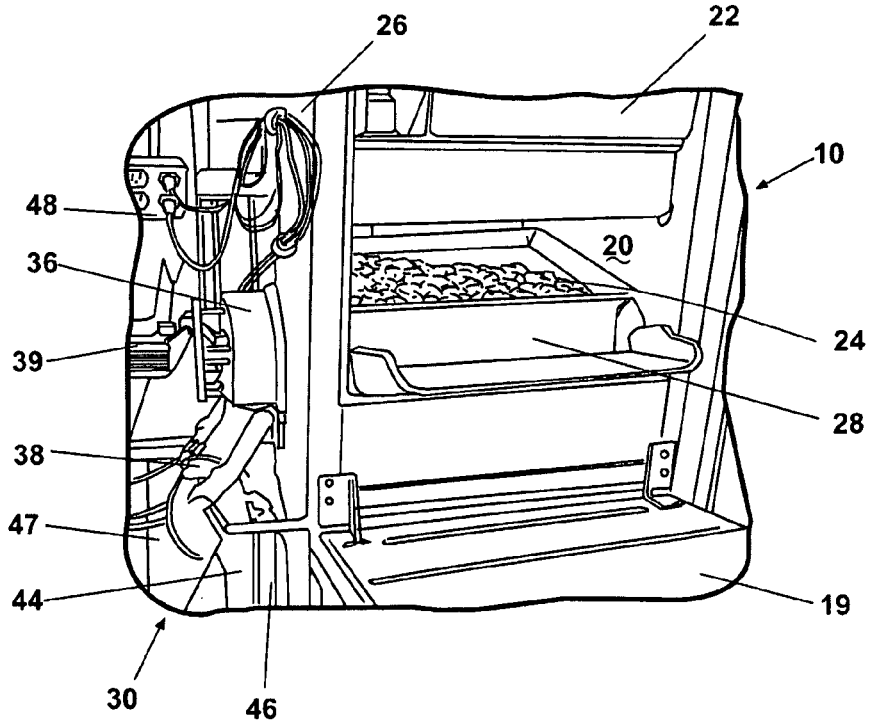
FIG. 17 is a partial perspective view of the undercounter ice maker and countertop ice dispenser of FIG. 16 illustrating the ice cube storage bin and dispenser and a portion of the ice lifter apparatus.
Figure 18:
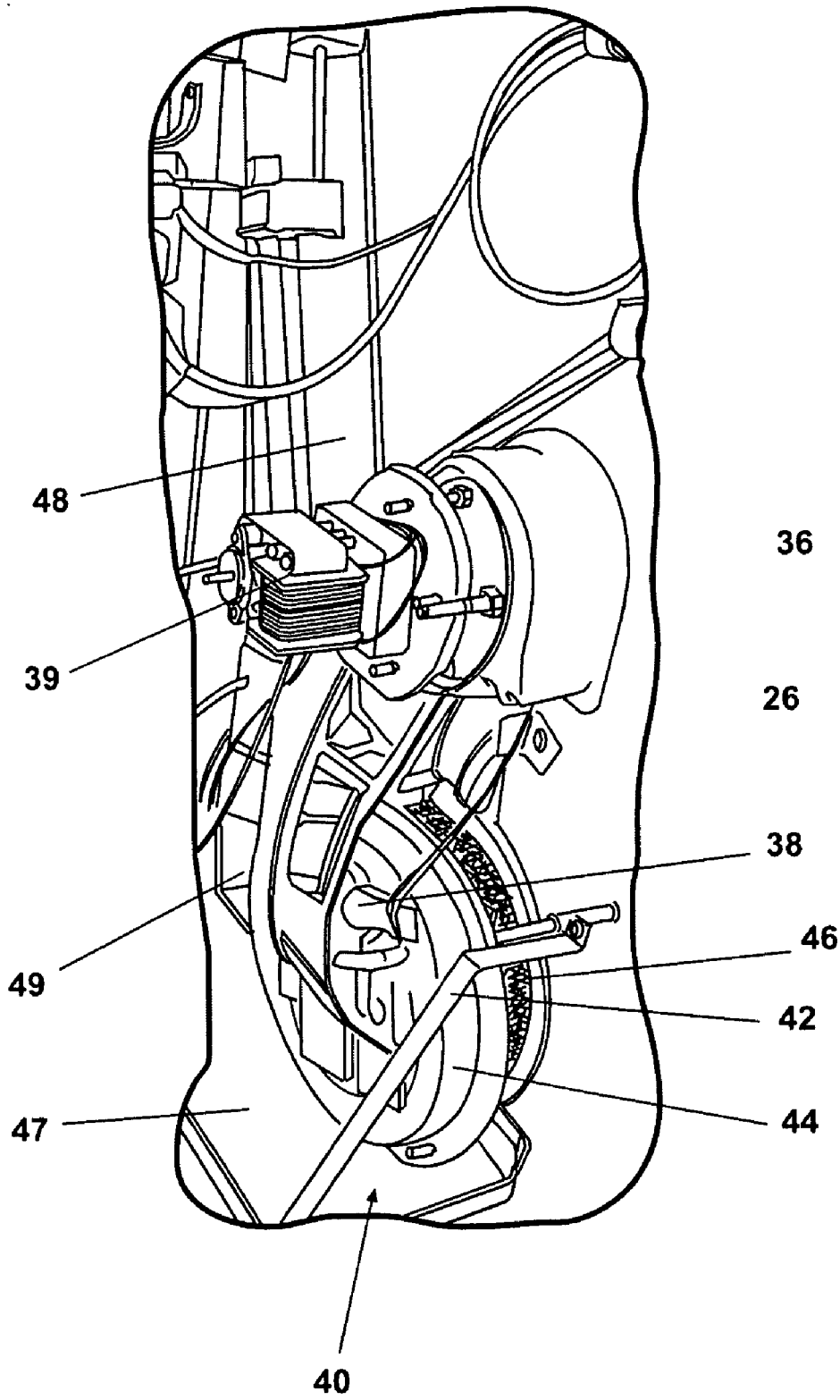
FIG. 18 is a partial perspective view of the undercounter ice maker and countertop ice dispenser of FIG. 16 illustrating the ice dispensing and ice lifter apparatus positioned under the countertop.
Figure 19:
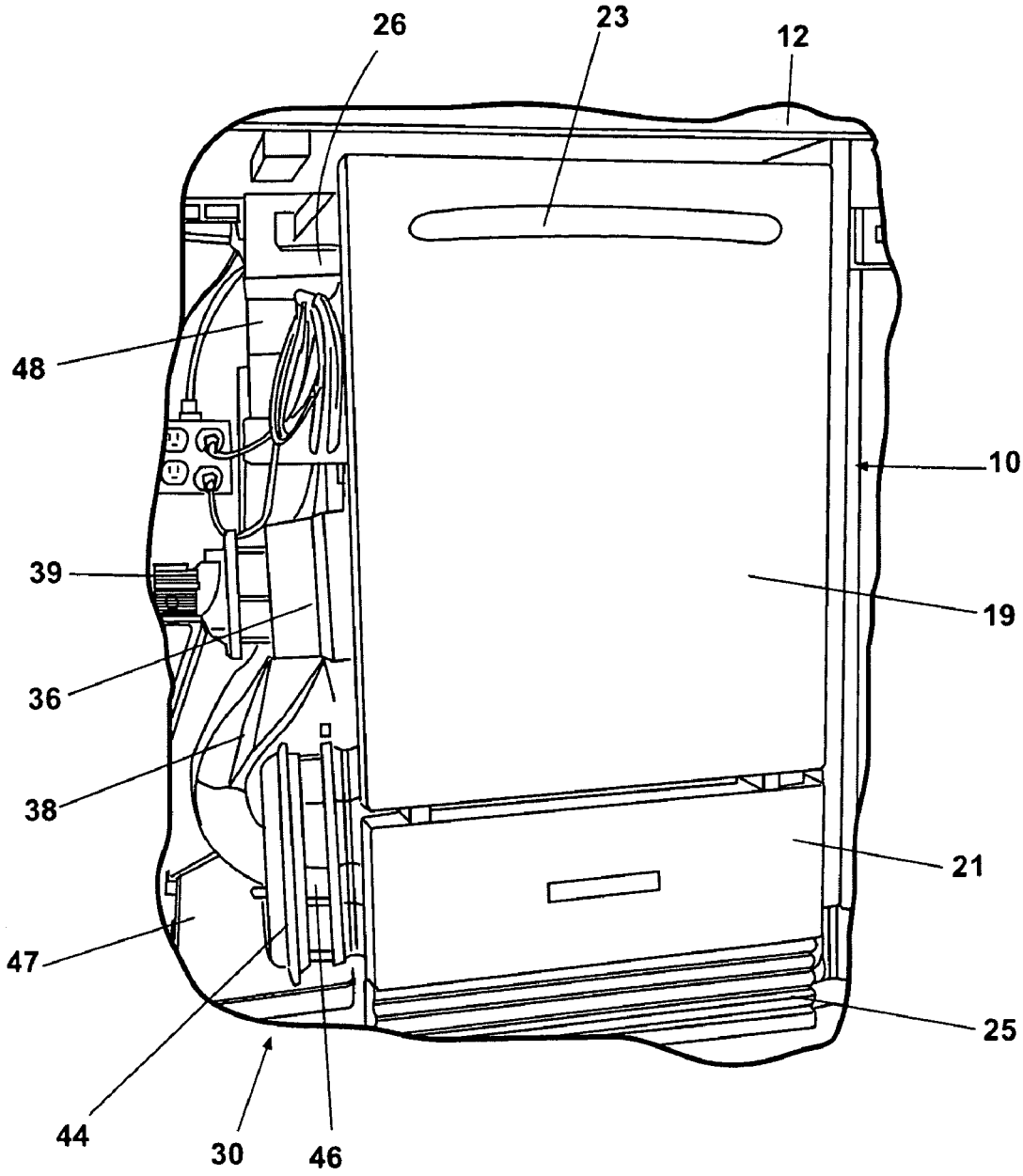
FIG. 19 is a partial perspective view of the undercounter ice maker of FIG. 16 illustrating the ice maker with the door closed.

As illustrated in FIGS. 14A-E, the auger ice lifter 330 can be operably connected to an ice storage and delivery assembly similar to that previously described herein, and can comprise an ice maker 246, and an ice cube storage bin 248. The lifter 330 can receive ice cubes from the ice cube storage bin 248 and deliver the ice cubes to a dispenser 72. As illustrated in FIG. 14E, ice from the ice cube storage bin 248 can contact horizontal auger 348 that can be positioned in a semi-circular trough in the bottom of ice cube storage bin 248. Operation of the horizontal auger assembly 334 can transport ice cubes toward the vertical auger assembly 332. As illustrated in FIG. 14F, the horizontal auger assembly 334 can be operably connected to the vertical auger assembly 332 so that ice cubes traveling to the end of the horizontal auger assembly 334 are transferred to the vertical auger assembly 332. Alternatively, vertical auger assembly 332 can be positioned directly in ice cube storage bin 248. The vertical auger assembly 332 can be adapted, such as with an opening in the auger housing 342, to take ice cubes from ice cube storage bin 248 and transport them vertically upwardly to an ice cube dispenser 72. Ice dispenser 72 can be part of a bottom freezer refrigerator or an undercounter ice maker and positioned on a countertop adjacent the undercounter ice maker. Horizontal auger assembly 334 can be replaced with an alternate ice cube transport assembly, for example a conveyor belt assembly, an inclined chute extending from the ice maker 246 to the vertical auger assembly 332 for gravity feed, and the like.

Vertical auger housing 344 can comprise a suitably insulated enclosure in the refrigerator compartment 54 to maintain a temperature differential between the auger ice lifter 330 and the refrigerated compartment 54, and to prevent the flow of chilled air to the refrigerated compartment 54. Alternatively, the vertical auger assembly 332 can be enclosed within side wall 60 surrounded by insulation, to maintain a sufficiently cold temperature in the vertical auger assembly 332. Flaps or doors cover an ice cube discharge outlet (not shown) from the lifter 330 to prevent the flow of chilled air from the lifter 330 into the refrigerated compartment 54.

In order to avoid melting of ice cubes in the vertical auger assembly 332 extending through the refrigerator cabinet 54, the vertical auger 346 can be reversed after dispensing has been completed to bring ice cubes remaining in the vertical auger assembly 332 back to the freezer compartment 56 by reversing the movement of the vertical auger 346 and the horizontal auger 348 until all ice cubes 260 have been removed from the refrigerated compartment 54.

Referring now to FIGS. 15 to 19, an embodiment of an undercounter ice maker 10, incorporating an ice dispensing apparatus similar to the ice making and dispensing apparatus in FIGS. 9A and B, is illustrated mounted beneath a countertop 12 with conventional kitchen cabinetry 14, 16. Undercounter ice maker 10 can comprise a well-known ice maker such as disclosed in U.S. Pat. Nos. 4,009,595; 6,484,529 and 6,539,742 fully incorporated herein by reference. Alternately, undercounter ice maker 10 can be an undercounter freezer having an ice maker and storage bin in the freezer compartment. Ice maker 10 can include an insulated cabinet 18 defining a ice maker compartment 20 suitable for maintaining a temperature appropriate for forming and storing ice cubes. The temperature in the compartment 20 can be maintained in a well-known manner through the use of a cooling system comprising a motor-driven compressor and evaporator containing a suitable coolant, a ventilation fan, appropriate thermostatic controls, and the like. The freezer compartment 20 can contain an ice making apparatus 22 adapted for continuously making ice cubes 24. Ice making apparatus 22 can be connected to a suitable water supply (not shown) having appropriate flow controls and a drain (not shown) for draining water not used in ice cube formation or from melting ice cubes as is well known. Insulated cabinet 18 can have a side wall 26 that can support ice dispensing apparatus 30 operably connected to ice maker 10 and arranged to elevate ice cubes to dispenser 32 that can be located on countertop 12 for easy access to ice cubes and chilled water.

Ice maker 10 can have a door 19 that can be pivotally mounted to the front of ice maker 10. In the embodiment of FIGS. 15 to 19 door 19 can be arranged to pivot on a horizontal axis to the open position illustrated in FIG. 17. Those skilled in the art will understand that door 19 can be pivotally mounted on a vertical axis if desired. An access panel 21 can be provided below door 19 to afford access to ice maker components under compartment 20. A louvered toe plate 25 can be provided at the bottom of ice maker 10 to provide air flow to refrigeration equipment for ice maker 22. Door 19 can have a suitable handle 23. In addition to providing dispensing of ice cubes 24 on countertop 12, ice cubes can be accessed in bulk by opening door 19 for direct access to ice cube storage bin 28.

Ice maker 22 can be arranged to drop the ice cubes 24 into an ice cube storage bin 28 for delivery to a dispenser apparatus 30. Ice cube storage bin 28 can incorporate a mover, not shown, that can be similar to auger 180 in ice cube storage bin 178 illustrated in FIG. 9B. The mover, not shown, in ice cube storage bin 28 can be arranged to advance ice cubes into discharge collar 36 that can be positioned on side wall 26 through suitable openings in compartment 20 and side wall 26. Those skilled in the art will understand that discharge collar 36 can include a generally cylindrical wall, not shown, extending through side wall 26 and into ice cube storage bin 28 to form a passage for ice cubes and the auger, not shown. Alternately, ice cube storage bin 28 can be arranged for gravity feed of ice cubes to discharge collar 36 for delivery to curved conduit 38. Curved conduit 38 can operatively connect a discharge opening, not shown, in discharge collar 36 with an inlet 42 in accelerator cover 44 for rotating accelerator 40. Accelerator 40 can include an accelerator housing 46 enclosing an accelerator wheel, not shown. Accelerator 40 can be similar to and function like the accelerator shown and described in conjunction with FIGS. 8 to 11. A conduit 48 can extend from accelerator housing 46 to dispenser 32 on countertop 12. Conduit 48 can have a return curve at its top end like the upper conduit 188 that can extend into dispenser 32 as in the embodiment of FIGS. 8 to 11. Accelerator 40 can be arranged, as previously described with respect to the embodiment illustrated in FIGS. 8 to 11, to receive ice cubes 24 from the storage container 28, and propel the ice cubes 24 through conduit 48 to dispenser 32. Accelerator 40 can include an accelerator wheel, not shown, that can be similar to the accelerator wheel 186 in the embodiment of FIGS. 8-11. Accelerator 40 can also include a motor, not shown, that can be integral with accelerator 40, or can be located under compartment 20 in ice maker 10. The operation of accelerator 40 can be similar to accelerator 173 as described above in conjunction with FIGS. 8-11.

As in the embodiment of FIGS. 8 to 11, accelerator 40 can be arranged to propel ice cubes 24 with sufficient velocity to carry the ice cubes over the top of conduit 48, not shown, and into dispenser 32. A return conduit 49 can extend downwardly from the conduit 48 to a drain pan 47 that can be connected to the ice maker drain, not shown. Conduit 48 can extend upwardly and an angle to vertical from the accelerator 40. A return conduit 49 can extend downward from a return duct inlet (not shown) on the underside or bottom wall of conduit 48 to drain pan 47. Thus, ice cubes 24 in the conduit 48 that are not dispensed through the dispenser 32 when accelerator 40 stops can slide down conduit 48 to return conduit 49 and then fall into the drain pan 47. Ice cubes falling into drain pan 47 can melt and flow to the undercounter ice maker drain, not shown. Those skilled in the art will understand that return conduit 49 can be eliminated and ice cubes not dispensed when accelerator stops can fall back into the accelerator 40 or back into the ice cube storage bin 28.

The upper portion of the conduit 48 and dispenser 32 can be at room temperature. Ice dispenser 32 can include a pivotally mounted door (not shown) to close the outlet of conduit 48 when the dispenser is not activated that can be similar to doors for closing the outlet of a through the door ice dispenser are well known in the art. One example of such a door can be seen in U.S. Pat. No. 4,942,979 to Lindstromberg et al referred to above. Thus, the dispenser outlet 32 and conduit 48 can be effectively sealed from compartment 20 in cabinet 18 by a door, accelerator 40 and discharge collar 36 to prevent the loss of chilled air from the compartment 20. A water supply (not shown) can be integrated into the dispenser 32 to selectively provide ice cubes, water, or a combination of both to a user utilizing well-known water delivery devices. A tank, not shown, can be included in compartment 20 to store a quantity of water for the water dispenser. The tank can be chilled by the near freezing temperatures normally existing in compartment 20 to facilitate ice cube storage in ice cube bin 28. Those skilled in the art will understand that ice cube bin 28 can include a suitable drain connection, not shown, on the bottom wall of bin 28 to carry water from melting ice cubes to drain, not shown. While the ice cube lifter described in conjunction with the undercounter ice maker above is an accelerator lifter, those skilled in the art will understand that any of the embodiments of ice cube lifter according to the invention can be used with an undercounter ice maker as well as a bottom freezer refrigerator.

The inventive concepts described herein provide the convenience of ice and water dispensing on the refrigerator compartment door of a bottom-mount refrigerator. Since the refrigerated compartment is accessed more frequently than the freezer compartment, the refrigerated compartment occupies the upper portion of the cabinet, improving access to refrigerated items. The less-frequently accessed freezer compartment occupies the lower portion of the cabinet, extending the width of the cabinet. Unlike a side-by-side refrigerator, the full width freezer compartment can accommodate large items. The ice making device can be located in the freezer, and the ice cubes can be transported by a transporting mechanism from the freezer compartment to the through-the-door ice cube dispensing device in order to minimize the loss of refrigerated compartment space. The ice cube transporting mechanism can be used in conjunction with an undercounter ice maker to supply ice cubes to a dispenser positioned on the countertop.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

We claim:

1. A refrigerator comprising:

a cabinet defining a freezer compartment maintained at a temperature below 0° C., and a refrigerator compartment located substantially above the freezer compartment maintained at a temperature above 0° C.;

a refrigerator compartment door moveably mounted to the cabinet for selectively closing the refrigerator compartment;

an ice maker for generating ice cubes located within the freezer compartment;

a dispenser outlet located in the refrigerator compartment door; and an ice dispenser operably connecting the ice maker to the dispenser outlet such that ice cubes generated by the ice maker are dispensed through the dispenser outlet comprising:

an ice cube storage bin positioned below the ice maker in the freezer compartment for receiving the ice cubes generated by the ice maker, and a lifter extending from adjacent the ice cube storage bin toward the dispenser outlet for moving ice cubes toward the dispenser outlet comprising an elevator having a lifting platform which is moveable between a loading position, where the ice cubes are loaded onto the platform, and a dispensing position, where the loaded ice cubes are positioned for dispensing through the dispenser outlet; and a deflector to deflect the ice cubes carried by the platform to the dispenser outlet wherein the deflector is a stripper having multiple teeth, and the lifting platform has multiple openings corresponding to the teeth, such that the teeth are received within the openings as the platform is lifted to strip any ice cubes on the platform off of the platform.

2. The refrigerator according to claim 1, wherein the lifter comprises a conveyor belt comprising a plurality of lifting platforms.

3. A refrigerator comprising:

a cabinet defining a freezer compartment maintained at a temperature below 0° C., and a refrigerator compartment located substantially above the freezer compartment maintained at a temperature above 0° C.;

a refrigerator compartment door moveably mounted to the cabinet for selectively closing the refrigerator compartment;

an ice maker for generating ice cubes located within the freezer compartment;

a dispenser outlet located in the refrigerator compartment door; and an ice dispenser operably connecting the ice maker to the dispenser outlet such that ice cubes generated by the ice maker are dispensed through the dispenser outlet comprising:

a storage bin located to receive the ice cubes from the ice maker; and an accelerator for moving ice cubes from the storage bin to the dispenser outlet comprising:

an accelerator housing in the freezer compartment having an inlet coupled to the storage bin to receive ice cubes from the storage bin and an outlet;

a conduit extending from the accelerator housing outlet upwardly to adjacent the dispenser outlet in the refrigerator compartment door; and a rotatable accelerator wheel rotatably mounted in the accelerator housing for propelling ice cubes out the accelerator housing outlet;

wherein the accelerator wheel propels ice cubes out the accelerator housing outlet into the conduit with sufficient velocity to propel the ice cubes upwardly through the conduit to the dispenser outlet.

4. A refrigerator comprising:

a cabinet defining a freezer compartment maintained at a temperature below 0° C., and a refrigerator compartment located substantially above the freezer compartment maintained at a temperature above 0° C.

a refrigerator compartment door moveably mounted to the cabinet for selectively closing the refrigerator compartment;

an ice maker for generating ice cubes located within the freezer compartment;

a dispenser outlet located in the refrigerator compartment door; and an ice dispenser operably connecting the ice maker to the dispenser outlet such that ice cubes generated by the ice maker are dispensed through the dispenser outlet comprising:

a storage bin located below the ice maker in the freezer compartment to receive the ice cubes from the ice maker; and an accelerator for moving ice cubes from the storage bin to the dispenser outlet comprising:

an accelerator housing in the freezer compartment having an inlet coupled to the storage bin to receive ice cubes from the storage bin and an outlet;

a conduit extending from the accelerator housing outlet upwardly to adjacent the dispenser outlet in the refrigerator compartment door; and a rotatable accelerator wheel rotatably mounted in the accelerator housing for propelling ice cubes out the accelerator housing outlet;

wherein the accelerator wheel propels ice cubes from the storage bin into the conduit with sufficient velocity to propel the ice cubes upwardly through the conduit to the dispenser outlet, and wherein the conduit further comprises a backflow device for directing accelerated ice cubes that fall back down the conduit to the storage bin.

5. The refrigerator according to claim 4, wherein the backflow device comprises a baffle located within the conduit and a return duct with an inlet in the conduit upstream of the baffle, the baffle is operable between a first position where it blocks the ice cubes from entering the return duct inlet while leaving the conduit open, and a second position, where it closes the conduit while leaving the duct inlet open to permit falling ice cubes to enter the return duct.

6. The refrigerator according to claim 5, wherein the baffle is normally biased into the second position and is moved to the first position by the impact of an ice cube propelled by the accelerator wheel, with the baffle returning to the second position after the passing of the ice cube.

7. The refrigerator according to claim 3, wherein the conduit further comprises a return duct with an inlet in the conduit intermediate the accelerator wheel and the dispenser outlet, wherein the conduit extends toward the dispenser outlet at angle relative to vertical, and wherein the return duct inlet into the conduit is on the underside of the conduit and the return duct extends downward from the underside of the conduit wherein ice cubes sliding down the conduit enter the return duct.

* * * * *